US008590894B2

(12) United States Patent
Sorge

(10) Patent No.: US 8,590,894 B2
(45) Date of Patent: Nov. 26, 2013

(54) ROULETTE GAME APPARATUS AND METHOD

(76) Inventor: Nicholas Sorge, Deer Park, NY (US)

( * ) Notice: Subject to any disclaimer, the term of this patent is extended or adjusted under 35 U.S.C. 154(b) by 156 days.

(21) Appl. No.: 12/880,814

(22) Filed: Sep. 13, 2010

(65) Prior Publication Data

US 2012/0061912 A1 Mar. 15, 2012

(51) Int. Cl.
*A63F 5/02* (2006.01)

(52) U.S. Cl.
USPC ..... 273/142 E; 273/274; 273/138.1; D21/375

(58) Field of Classification Search
USPC ..... 273/142 E, 274, 138.1; D21/375; 463/17
See application file for complete search history.

(56) References Cited

U.S. PATENT DOCUMENTS 4,077,631 A 3/1978 Tela, Sr.
5,540,442 A 7/1996 Orselli et al.
6,059,659 A * 5/2000 Busch et al. ..... 463/17
6,302,395 B1 * 10/2001 Astaneha ..... 273/274
6,352,260 B1 * 3/2002 Santiago ..... 273/274
6,406,021 B1 * 6/2002 Nadibaidze ..... 273/274
6,406,022 B1 * 6/2002 Nadibaidze ..... 273/274
6,467,770 B1 * 10/2002 Matosevic ..... 273/274
7,571,910 B1 * 8/2009 Launzel ..... 273/142 NHA
7,588,250 B2 * 9/2009 Sorge ..... 273/143 R
7,637,503 B2 * 12/2009 Sorge ..... 273/274
7,694,971 B2 * 4/2010 Sorge ..... 273/274
2007/0222145 A1 9/2007 Sorge
2008/0224393 A1 9/2008 Sorge

OTHER PUBLICATIONS

International Search Report dated Apr. 27, 2012 issued in International Application No. PCT/US2011/050914.

* cited by examiner

*Primary Examiner* — Benjamin Layno
(74) *Attorney, Agent, or Firm* — Scully, Scott, Murphy & Presser, P.C.

(57) ABSTRACT

A Balanced Roulette game and Balanced Roulette method for arranging indicia on a Balanced Roulette Wheel game surface and on an associated Balanced Roulette wheel having indicia indicating non-house numbers from 1 through 36. A Balanced Super Roulette game and method for arranging indicia on a Balanced Super Roulette wheel game surface and on an associated Balanced Super Roulette Wheel having indicia indicating non-house numbers from 1 through 60. Each of the Balanced Roulette and Balanced Super Roulette wheels/game surfaces have indicia (number and color) arranged such that the impact of wheel Bias that affects bettor payouts for multi-number bets is reduced.

27 Claims, 9 Drawing Sheets

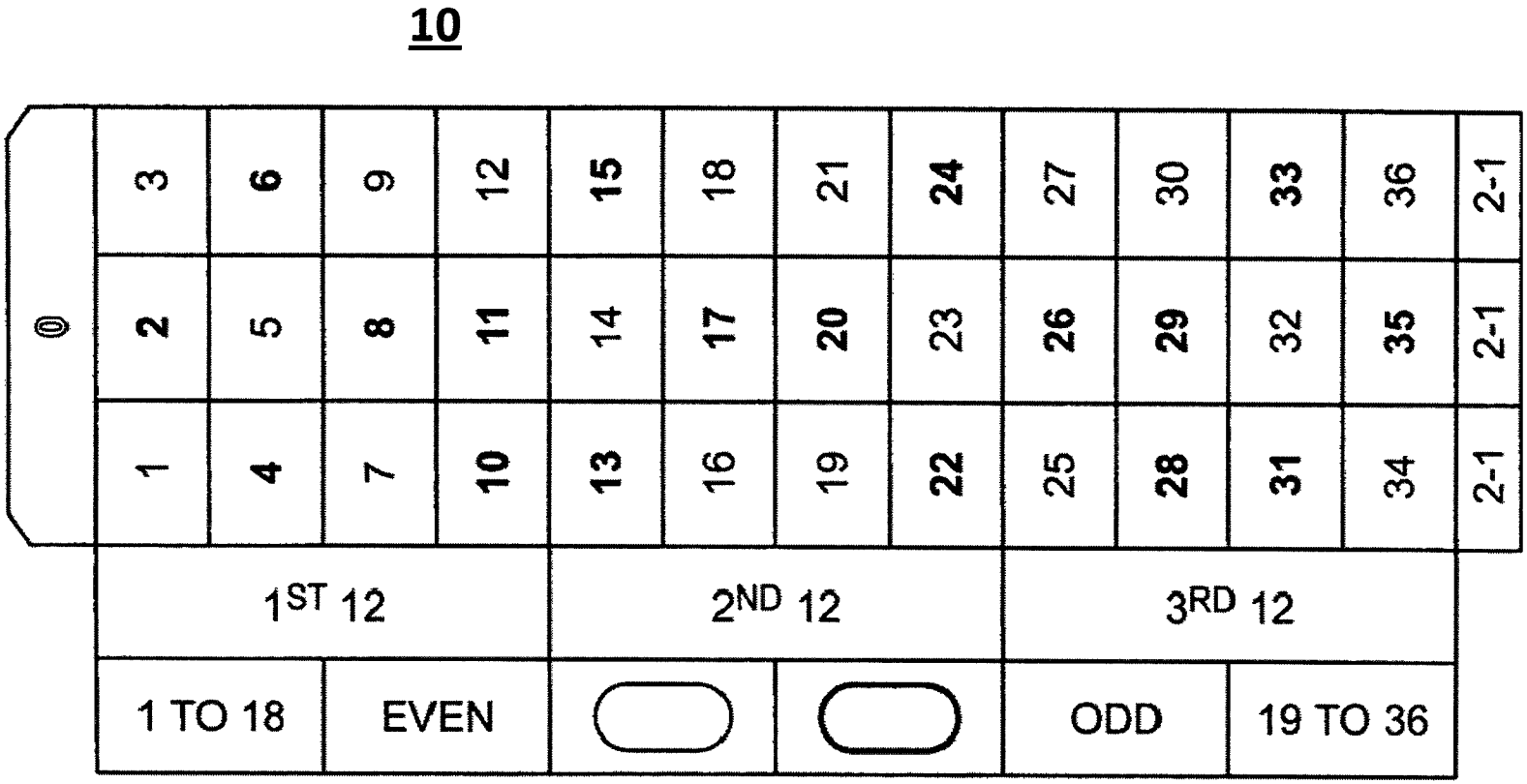
FIG. 1 [Prior Art]

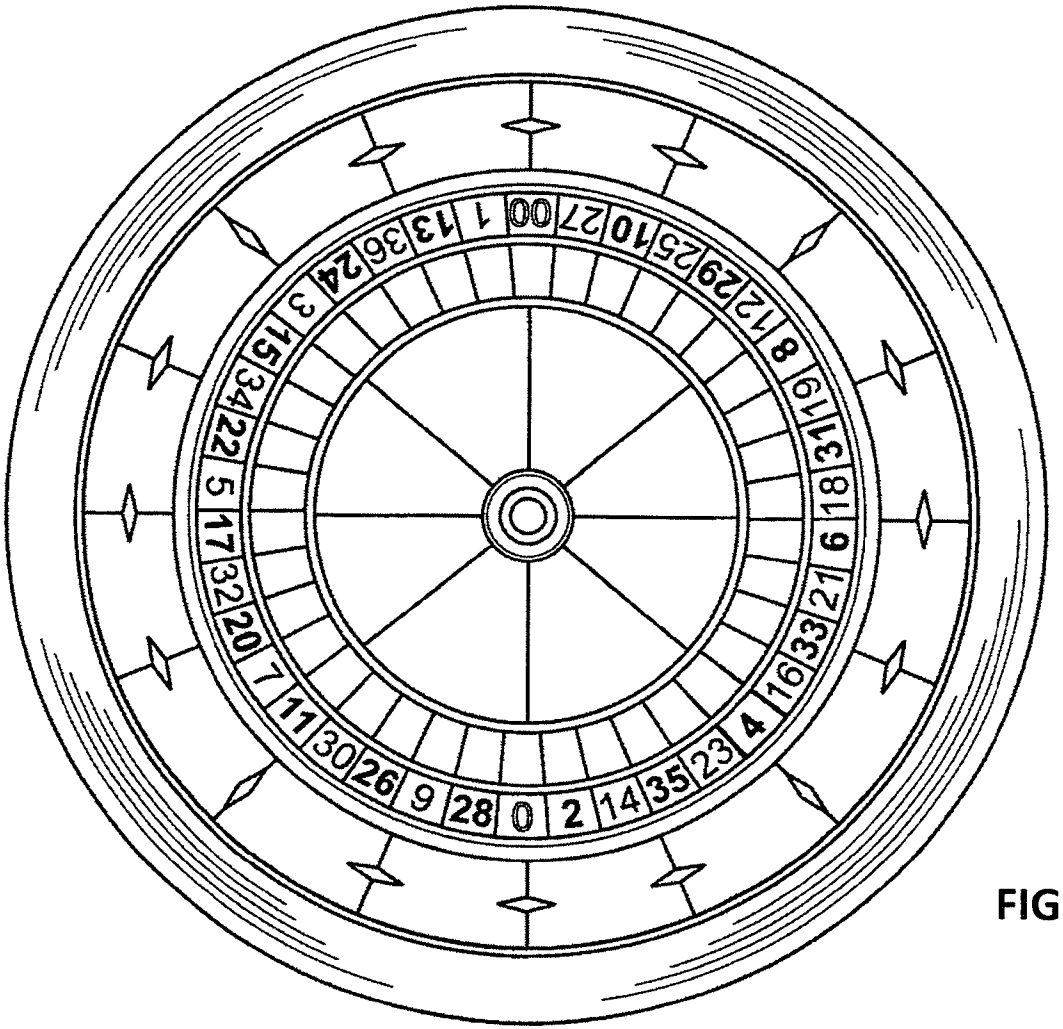
FIG. 1A [Prior Art]

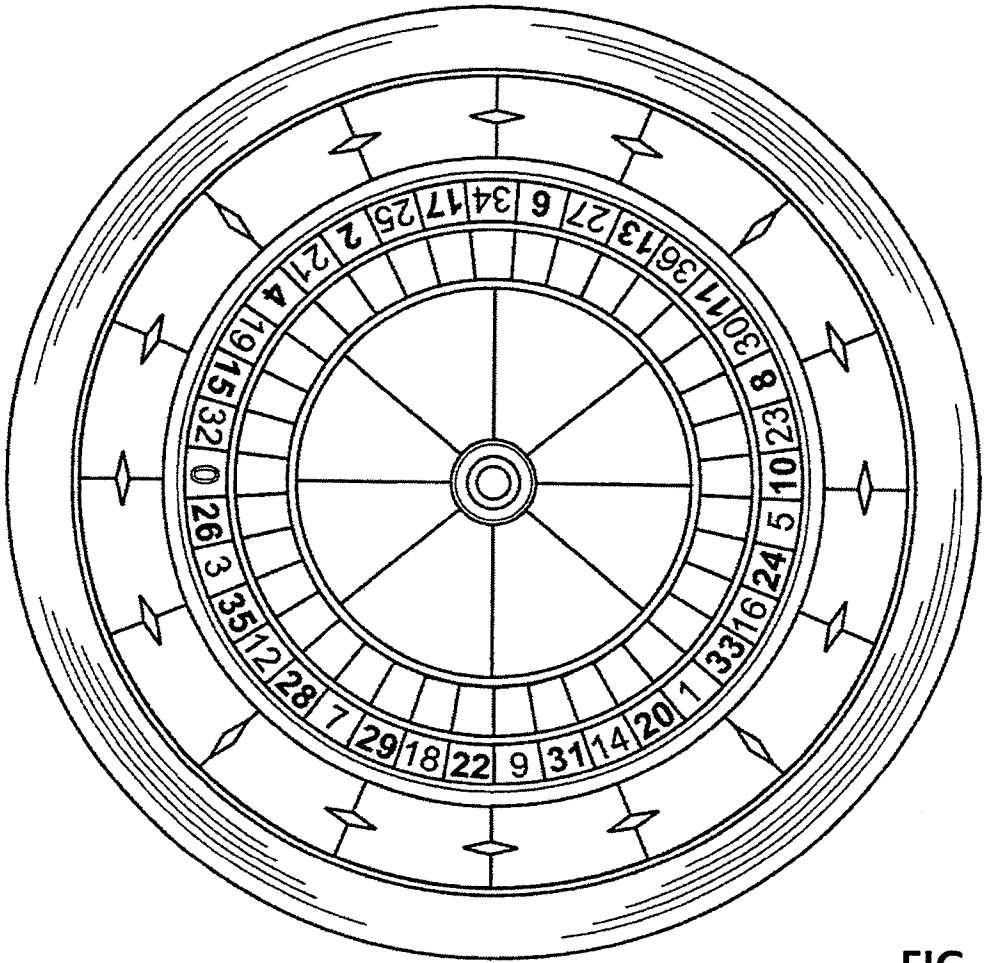
FIG. 1B [Prior Art]

200

300

310

ROULETTE GAME APPARATUS AND METHOD

BACKGROUND OF THE INVENTION

The invention relates to apparatuses for playing roulette and methods for arranging indicia on roulette game surfaces and roulette wheels.

Roulette is a well-known game of chance enjoyed throughout the world. The equipment used for playing roulette generally comprises a roulette wheel and a game surface.

The roulette wheel generally comprises a horizontally disposed wheel mounted in a bowl-shaped housing. The wheel is adapted to rotate about a vertical axis and includes a plurality of pockets disposed around its periphery. Each pocket has a unique number associated with the pocket, as well as a color associated therewith. Each pocket is adapted to receive a small ball which is introduced into the bowl shaped housing by an operator or croupier as the wheel is set in motion. The wheel is typically spun in one direction and the ball projected around the circumference of the housing in an opposite direction. As the ball loses speed, it rolls down the concave housing wall, eventually coming to rest in one of the pockets. The outcome or result of the spin is the number and color associated with the pocket in which the ball comes to rest.

The game surface includes a plurality of wagering areas indicating various numbers, colors, parities (the odd or even quality of a number) and groupings of numbers. One or more players make wagers on a predicted outcome of a spin of the roulette wheel. A player indicates his or her wager by placing one or more wagering devices, such as chips or markers representing an amount of the wager, at a predetermined location on the game surface corresponding to a predicted outcome of a spin of the roulette wheel.

A prior art "Standard" roulette game surface or board 10 is shown in FIG. 1. As shown the game surface includes wagering areas corresponding to the individual numbers 1 through 36. The numbers are arranged sequentially in three columns of twelve numbers each and twelve rows or streets of three numbers each. Eighteen of the numbers (1, 3, 5, 7, 9, 12, 14, 16, 18, 19, 21, 23, 25, 27, 30, 32, 34 and 36) correspond to a first color, typically red, and the remaining eighteen numbers (2, 4, 6, 8, 10, 11, 13, 15, 17, 20, 22, 24, 26, 28, 29, 31, 33 and 35 correspond to a second color, typically black. In the prior art arrangement, there are eight even red numbers (12, 14, 16, 18, 30, 32, 34 and 36), ten odd red numbers (1, 3, 5, 7, 9, 19, 21, 23, 25, and 27), ten even black numbers (2, 4, 6, 8, 10, 20, 22, 24, 26 and 28) and eight odd black numbers (11, 13, 15, 17, 29, 31, 33 and 35).

A player may place a wager on a particular number by placing one or more chips or markers within the wagering area corresponding to that number. The table layout permits the player to place bets on individual numbers or combinations or groupings of individual numbers. For example, a player can wager on a column of numbers by placing one or more chips or markers adjacent to the column of numbers, on a row of numbers by placing one or more chips or markers adjacent to the row of numbers, on two rows of numbers by placing one or more chips or markers adjacent to the two rows of numbers, and on four adjoining numbers by placing one or more chips or markers at the intersection of the four adjoining numbers.

As shown in FIG. 1, wagering areas are also typically provided for betting on the number 0 (and/or the number 00 in an American style wheel as described more fully herein), on a particular color outcome (for example red or black), on an even or odd number outcome, on an outcome comprising a number from 1 to 18, on an outcome comprising a number from 19 to 36 and on a particular set or block of numbers (for example first twelve number 1 through 12, second twelve numbers 13 through 24 or last twelve numbers 25 through 36).

Winning wagers in the game of roulette are paid out at predetermined multiples based on the probability of the particular predicted outcome. For example, a winning wager for an individual number may pay out at a ratio of 35 to 1; a winning wager for a row of three numbers may pay out at a ratio of 11 to 1; a winning wager for a group of four adjacent numbers may pay out at a ratio of 8 to 1; a winning wager for two adjacent rows of number may pay out at a ratio of 5 to 1; a winning wager for the combination of numbers 1 to 18 or the combination of numbers from 19 to 36 may pay out at a ratio of 1 to 1; a winning wager on a column of numbers may pay out at a ratio of 2 to 1; a winning wager on a block of twelve consecutive numbers (first twelve, second twelve or last twelve) may pay out at a ratio of 2 to 1, and a winning wager on an odd number; an even number, a red number or a black number may pay out even money. Other wager combinations and associated payout ratios may also be used. Table I below shows an example betting arrangements and corresponding payouts ratios:

TABLE I

| | |
|---|---|
| Individual number bet | 35:1 |
| 2-number bet | 17:1 |
| 3-number bet | 11:1 |
| 4-number bet | 8:1 |
| 6-number bet | 5:1 |
| 12-number bet | 2:1 |
| 18-number bet | 1:1 |

The prior art (standard) American roulette wheel arrangement is shown in FIG. 1A. As shown, the prior art American wheel includes both zero (0) and double zero (00) house numbers arranged opposite each other and thirty six numbers from 1 to 36 arranged around the perimeter of the wheel for a total of thirty eight pockets.

The numbers from 1 to 36 are arranged at standardized positions on the prior art American wheel as shown in FIG. 1A. In the standard American wheel the compartments are numbered and colored clockwise from 0 as follows: 0, 28, 9, 26, 30, 11, 7, 20, 32, 17, 5, 22, 34, 15, 3, 24, 36, 13, 1, 00, 27, 10, 25, 29, 12, 8, 19, 31, 18, 6, 21, 33, 16, 4, 23, 35, 14, 2. The house numbers (0, 00) are typically green in color. The numbers 1, 3, 5, 7, 9, 12, 14, 16, 18, 19, 21, 23, 25, 27, 30, 32, 34 and 36 are red, and the numbers 2, 4, 6, 8, 10, 11, 13, 15, 17, 20, 22, 24, 26, 28, 29, 31, 33 and 35 are black. Black and red numbers alternate, and directly across the wheel from each odd number is the next highest even number (for example the number 10 is directly across the wheel from the number 9).

FIG. 1B shows the prior art European roulette wheel arrangement. In the standard European roulette wheel as shown in FIG. 1B, the wheel compartments are numbered and colored clockwise from 0 as follows: 0, 32, 15, 19, 4, 21, 2, 25, 17, 34, 6, 27, 13, 36, 11, 30, 8, 23, 10, 5, 24, 16, 33, 1, 20, 14, 31, 9, 22, 18, 29, 7, 28, 12, 35, 3, 26. As shown, the European roulette wheel arrangement includes only one house number, the single zero (0) and thirty six numbers, for a total of thirty seven pockets. This results in a significantly lower house advantage for the European wheel (house edge=1/37 or approximately 2.70%) as compared to the American wheel (house edge=2/38 approximately 5.26%). The individual numbers from 1 to 36 in the prior art European roulette wheel have the same colors as they have in the prior art American roulette wheel, and the numbers are also arranged at standardized positions; however the arrangement of numbers around the wheel differs substantially in the European roulette wheel as compared to the American wheel.

As described in detail in applicant's issued U.S. Pat. No. 7,588,250, the contents of which are incorporated by reference as if fully set forth herein, the arrangement of numbers and colors on the prior art roulette game surface shown in FIG. 1 (and used with both the prior art American roulette wheel arrangement shown in FIG. 1A and the prior art European roulette wheel arrangement shown in FIG. 1B) is not optimized or balanced with respect to the entire game surface, the individual columns and the individual dozen wagering groups (1-12, 13-24 and 25-36), as set forth below. In particular, the distribution of red, black, odd and even numbers on the prior art roulette game surface is unbalanced and as a result experienced players may combine bets on red, black, even and odd numbers, columns and dozen groups to increase the player's chances of winning a bet. In addition, an inexperienced player may lack the knowledge to take advantage of these relationships, resulting in a greater advantage for the casino or house.

In one example, as shown in FIG. 1, the prior art roulette game surface arrangement has ten red odd numbers (1, 3, 5, 7, 9, 19, 21, 23, 25 and 27), but only eight red even numbers (12, 14, 16, 18, 30, 32, 34 and 36). Additionally, the prior art arrangement has ten black even numbers (2, 4, 6, 8, 10, 20, 22, 24, 26, 28), but only eight black odd numbers (11, 13, 15, 17, 29, 31, 33 and 35). This imbalance in the distribution of red, black, odd and even numbers throws off the balance of the individual columns and dozen wagering areas.

Further, the relationships among adjacent numbers on the prior art roulette wheels and their corresponding positions, groupings and characteristics on the prior art roulette game surface may allow experienced players to combine bets on red, black, even and odd numbers, columns and dozen groups to increase the player's chances of winning. For example in the prior art arrangements, players may "flower" the wheel by placing bets corresponding to a group of numbers positioned on the roulette wheel adjacent or in close proximity to one another. By utilizing progressive betting techniques and taking advantage of the relationship between the positions of the numbers on the roulette wheel and the various betting schemes (red, black, odd, even, column, dozen group) a professional or experienced player may increase his or her odds of winning.

There exists a need for improved roulette board game surface and wheel arrangements having a more "balanced" layout wherein red and black and even and odd numbers are evenly distributed. Moreover, the need exists for an improved roulette game surface and wheel arrangement wherein relationships between adjacent pairs or groups of numbers on the wheel and the arrangement and characteristics of numbers on the game surface are eliminated.

More particularly, one aspect of the Roulette Wheel game that has yet to be addressed in the gaming industry with respect to the layout of the game surface board and Roulette wheel indicia in the standard roulette (36 non-house numbers) embodiments is the effect of bias. For example, as a standard mechanical roulette wheel of 36 non-house numbers is designed so that the 37 or 38 possible numerical outcomes occur randomly and unpredictably (i.e., each outcome is equally likely to occur and information about previous outcomes does not change the estimated probability of the next outcome), a tendency for a particular number to occur more or less likely than $1/37$ of the time in a standard European wheel, or $1/38$ of the time in a standard American wheel, is referred to as a "bias". Other types of non-randomness involving patterns of correlation between multiple outcomes, even while individual numbers remain equally likely on average, are also possible. Thus, sources of bias and non-randomness could cause roulette outcomes to become more predictable.

For mechanical roulette wheels, there is no software or numerical calculation occurring. The randomness is determined by the independence of the physical processes involved: the speed of rotation of the wheel; the deceleration of the rotation over time; the time at which a croupier releases the ball; the speed and spin with which the croupier releases the ball; the deceleration of the ball as it rotates before dropping; the bounces the ball makes when it hits the wheel; and the deflections of the ball by any baffles or other built-in irregularities in the bowl the wheel spins within.

Because the state of the system depends only on continuous physical variables such as rotation speed and ball position, there is no way for a mechanical roulette wheel to encode information about multiple previous outcomes. Therefore, the kinds of long range correlations between multiple outcomes that can occur in algorithmic random number generators are not significant in mechanical roulette wheels. Once the ball has fallen into a numbered slot, any information related to what slots it had previously fallen into is effectively erased. Although there may be a non-random relationship between one outcome and the next outcome, correlations and relationships between spins that are not consecutive are not to be expected, and tests for randomness in mechanical roulette wheels focus only on individual outcomes and correlations between consecutive outcomes. A deviation of the outcome probabilities from equality is referred to as an "absolute bias", and a non-random relationship between consecutive outcomes referred to as a "relative bias".

Absolute bias results from asymmetries in the roulette wheel. These can occur due to local irregularities (dents, nicks, slight differences in the size or shape of the numbered compartments, variations in the density or hardness of the material used to make the walls between compartments) or overall deviations (warping or deviations from circularity; unbalanced mounting so the wheel is not completely level).

The different sources of absolute bias will tend to result in different patterns of non-randomness in the outcome probabilities. These sources of absolute bias include:

1) A wheel which is not mounted levelly will show a circular or "dipole" variation in the probabilities, with one half of the wheel being more likely than the other half, and the highest-probability and lowest probability numbers being concentrated in opposite regions of the wheel.

2) A wheel which is warped, and so slightly elliptical rather than circular in shape, will show a quadruple variation in the probabilities, with the higher probability numbers concentrated in opposite regions of the wheel corresponding to one axis of the ellipse, and the lower probability numbers concentrated in the complementary regions corresponding to the other axis of the ellipse.

3) A wheel which was manufactured to loose tolerances or assembled with insufficient precision will tend to have many numbers with small deviations from the uniform probabilities.

4) A wheel which has been in operation for a long time and suffers from wear and tear will tend to have a few numbers with significant deviations from the uniform probabilities.

5) A wheel which has suffered some accident or external blow or tampering will tend to have a single number with a large deviation from the uniform probabilities.

Even when a roulette wheel is perfectly symmetrical and physically balanced, so that over time all numbers occur with equal probability, relative biases related to correlations between consecutive spins may occur. These are caused by insufficient variability in three continuous quantities determining roulette outcomes: rotational velocity of the wheel, speed with which the ball is released, and timing of the ball release relative to when the ball was removed from the slot it fell into on the previous spin. Too much uniformity in these variables will result in the quantity "total number of revolutions the ball makes" having a sufficiently non-uniform distribution that the relative angle between the outcome from the previous spin and the outcome from the current spin is also nonuniform in a detectable way.

Thus, the biases typically found in roulette wheels: 1) Bias due to irregularities in individual compartments or locations on the wheel; and 2) Bias due to an overall imbalance or asymmetry in the wheel's rotation (which may come from either imperfect manufacture or inaccurate installation) or, because of wear and tear on the wheel over time (e.g., people bumping into the wheel, vibrations, etc) causes drifting away from equal probabilities. The first kind of bias affects individual number bets. The second bias affects multiple number bets with "regions" of the wheel rather than individual numbers deviating from the expected probability. However, the second bias has a greater impact on the multiple number bets.

It would be highly desirable to provide a Roulette wheel apparatus, and a method for arranging indicia on a Roulette wheel that is more balanced than the prior art (standard) Roulette wheels such that the impact of the bias in the physical wheel is minimized.

It would be further highly desirable to provide a Roulette wheel apparatus, and a method for arranging indicia on a Roulette wheel that is more balanced than the prior art (standard) Roulette wheels, such that the impact of the second bias in the physical wheel is minimized.

It would be further desirable to provide a Roulette wheel apparatus, and a method for arranging indicia on a 36 number balanced Roulette wheel that is more balanced than the prior art (standard) Roulette wheels, such that the impact of the bias in the physical wheel is minimized by reducing impact of a biased wheel on the House Edge for various types of betting arrangements.

It would be further desirable to provide a Roulette wheel apparatus, and a method for arranging indicia on a 36 number balanced Roulette wheel to reduce the impact of a biased wheel on multi-number bets, by spreading the physical location of the numbers in a multi-number bet more evenly around the roulette wheel.

It would be further desirable to provide a Roulette wheel apparatus, and a method for arranging indicia on a 36 number balanced Roulette wheel to minimize the impact of bias on combinations of multi-number bets.

SUMMARY OF THE INVENTION

The present invention includes an improved roulette wheel game and apparatus of a "balanced" arrangement such that an impact of a biased wheel on the House Edge is reduced.

The present invention includes a first balanced roulette wheel apparatus that contains 36 numbers, excluding the house numbers, and a corresponding surface game board.

The present invention includes a first balanced roulette wheel apparatus that contains 60 numbers, excluding those house numbers, and a corresponding surface game board.

In both 36 number and 60 number embodiments, indicia on a game surface are associated with the corresponding roulette wheel type. The indicia on the game surface include all of the whole numbers on the roulette wheel arranged in numerical order, wherein one half of the whole numbers are associated with a first color and the remaining half are associated with a second color. The whole numbers are arranged on the game surface in columns and rows in ascending order beginning from a top left corner and proceeding from left to right across the rows. The whole numbers are arranged on the game surface such that the amount of whole numbers in each column is the same, and the amount of whole numbers in each row is the same. However, the number of rows may or may not be equal to the number of columns, and the number of whole numbers in the columns may or may not be equal to the number of whole numbers in the rows. The whole numbers in the game surface may be further grouped. But each grouping must contain the same number of whole numbers. But, the number of groups may or may not equal the number of rows or the number of columns. Further, the amount of whole numbers in each group may be the same or different from either the amount of whole numbers in each row or the amount of whole numbers in each column.

If the roulette wheel contains house numbers, the game surface indicia may or may not contain the house numbers. If house numbers are included in the game surface, they are arranged in an area separate from the indicia of whole numbers.

Excluding the house numbers, the number of whole numbers on the roulette wheel cannot be a prime number. In addition, the number of whole numbers on the roulette wheel is a number, which is an even number. Further, it is a number, which is evenly divisible by the number of columns and rows described hereinabove on the game surface. In an embodiment, the whole numbers on the game surface are divisible by 3, 4 or 5.

However, no matter how large the amount of whole numbers there are on the roulette wheel, no two adjacent numbers on the roulette wheel are associated with the same color, or are disposed adjacent one another on the game surface.

Thus, in one aspect, there is provided a method for arranging indicia on a game surface and on an associated roulette wheel for a roulette game, the method comprising the steps of:

a) arranging indicia indicating one or more house numbers on the game surface;

b) arranging indicia indicating thirty six whole numbers comprising the numbers 1 through 36, wherein one half of the whole numbers are associated with a first color and a remaining half of the whole numbers are associated with a second color, on the game surface in a matrix of three columns and twelve rows, the whole numbers being arranged in ascending order beginning from a top left corner and proceeding from left to right across the TOWS;

wherein the whole numbers are arranged in three groups of twelve numbers each, a first group comprising the numbers 1 through 12, a second group comprising the numbers 13 through 24 and a third group comprising the numbers 25 through 36; and wherein each of the first, second and third group comprise three even numbers associated with the first color, three odd numbers associated with first color, three even numbers associated with the second color and three odd numbers associated with the second color;

c) arranging indicia indicating the one or more house numbers on the roulette wheel; and d) arranging indicia indicating each of the thirty six whole numbers on the roulette wheel in a circumferential manner by:

selecting a first whole number associated with the first color and selecting a second whole number associated with the second color, the first and second whole numbers disposed in a single column of the three columns and disposed in a first group of the three groups, and indicating the first whole number and second whole number on the roulette wheel;

selecting a first further whole number associated with the first color and selecting a first further whole number associated with the second color, the first further whole number of the first color and first further whole number of the second color disposed in a single column of the three columns and disposed in a second group of the three groups, and indicating the first further whole number of the first color and first further whole number of the second color on the roulette wheel adjacent to one of: the first whole number or second whole number; and, selecting a second further whole number associated with the first color and selecting a second further whole number associated with the second color, the second further first and second whole numbers disposed in a single column of the three columns and disposed in a third group of the three groups, and indicating the second further whole number of the first color and second further whole number of the second color on the roulette wheel adjacent to one of the first further whole number of the first or second color; and repeating a first pattern on the roulette wheel such that one pair of adjacent non-house numbers on the roulette wheel are in a same group and same column on said game surface, and each successive pair of adjacent non-house numbers proceeding in a first direction on the roulette wheel from said one pair are in a same group and same column on said game surface;

repeating a second pattern on the roulette wheel such that no two adjacent non-house numbers on the roulette wheel are associated with a same color, are disposed in a same row on the game surface, and are disposed adjacent one another on the game surface; and, repeating a third pattern on the roulette wheel such that a first pair of adjacent non-house numbers on the wheel are both odd numbers and a second pair of non-house numbers adjacent the first pair are both even numbers, and successive alternating first pairs of two adjacent non-house numbers on the wheel proceeding in a first direction are odd; and successive alternating second pairs of two adjacent non-house numbers on the wheel proceeding in the first direction between each the successive alternating first pairs proceeding in the first direction are even.

Further to this embodiment, the method includes further arranging the whole numbers on the roulette wheel such that:

a third pair of adjacent numbers on the wheel sum to 37, and, a fourth pair of adjacent numbers on the wheel located substantially diametrically opposite the third pair of adjacent numbers on the wheel sum to 37, and such that a first non-house number immediately adjacent one number of the third pair indicated on the wheel in a first direction, and, a corresponding second non-house number immediately adjacent the other number of the third pair indicated on the wheel in a second direction sum to 37; and, repeating a fourth-pattern on the wheel such that, each successive non-house whole number on the wheel proceeding in the first direction between the first non-house number and the fourth pair of adjacent numbers and a corresponding successive non-house whole number on the wheel proceeding in the second direction between the second non-house number and the fourth pair of adjacent numbers sum to 37.

Further to this embodiment, each non-house whole number and a corresponding non-house whole disposed substantially diametrically opposite said non-house whole number are adjacent each other in a single column disposed in one of said first, second, or third groups.

Further to this embodiment, each non-house whole number and a corresponding non-house whole disposed substantially diametrically opposite said non-house whole number are the same color.

Further to this embodiment, the Balanced roulette wheel numbers are arranged in the following clockwise sequence: an optional house number, 18, 24, 11, 5, 30, 36, 23, 17, 4, 10, 35, 29, 16, 22, 3, 9, 28, 34, an optional house number, 15, 21, 8, 2, 27, 33, 20, 14, 1, 7, 32, 26, 13, 19, 6, 12, 25 and 31, with the house numbers being present being present between any two numbers. However, in an embodiment if the roulette wheel contain an even number of house numbers or if it contains an odd number of house numbers and the number of non-house numbers are divisible by the number of house numbers they are separated by the same number of non-house numbers so that they are arranged symmetrically on the wheel. For example, in an embodiment, a first non-house number is between 18 and 31 and a second house number is between 34 and 15.

In a further embodiment, there is provided a roulette game apparatus comprising:

a) a game surface comprising:

(i) one or more house number wagering areas;

(ii) an even number wagering area;

(iii) an odd number wagering area;

(iv) a first color wagering area;

(v) a second color wagering area;

(vi) a low number wagering area corresponding to a whole number from 1 to 18;

(vii) a high number wagering area corresponding to a whole number from 19 to 36;

(viii) a first dozen wagering area corresponding to a whole number from 1 to 12;

(ix) a second dozen wagering area corresponding to a whole number from 13 to 24;

(x) a third dozen wagering area corresponding to a whole number from 25 to 36; and (xi) thirty six individual number wagering areas, each corresponding to a whole number from 1 to 36, the thirty six individual number wagering areas arranged in ascending order in a matrix of three columns and twelve rows, wherein individual number wagering areas corresponding to numbers 1, 3, 4, 6, 8, 11, 13, 15, 16, 18, 20, 23, 25, 27, 28, 30, 32 and 35 are associated with the first color, and individual number wagering areas corresponding to numbers 2, 5, 7, 9, 10, 12, 14, 17, 19, 21, 22, 24, 26, 29, 31, 33, 34 and 36 are associated with the second color; and b) a roulette wheel comprising a plurality of pockets disposed in a circumferential manner, each of the pockets corresponding to a house number or to a whole number from 1 to 36, wherein each of the whole numbers is associated with the first color or the second color as on the game surface, and wherein the pockets are arranged on the roulette wheel such that one pair of adjacent non-house numbers on the roulette wheel are in a same group and same column on said game surface, and each successive pair of adjacent non-house numbers proceeding in a first direction on the roulette wheel from said one pair are in a same group and same column on said game surface, and, no two adjacent numbers on the roulette wheel are associated with a same color, are disposed in a same row on the game surface, or are disposed adjacent one another on the game surface; and, a first pair of adjacent non-house numbers on the wheel are both odd numbers and a second pair of non-house numbers adjacent the first pair are both even numbers, and successive alternating first pairs of two adjacent non-house numbers on the wheel proceeding in a first direction are odd; and successive alternating second pairs of two adjacent non-house numbers on the wheel proceeding in the first direction between each the successive alternating first pairs proceeding in the first direction are even.

In a further embodiment, there is provided a method for arranging indicia on a game surface and on an associated roulette wheel for a Super roulette game, the method comprising:

a) arranging indicia indicating one or more house numbers on the game surface;

b) arranging indicia indicating sixty whole numbers comprising the numbers 1 through 60, wherein one half of the whole numbers are associated with a first color and a remaining half of the whole numbers are associated with a second color, on the game surface in a matrix of five columns and twelve rows, the whole numbers being arranged in ascending order beginning from a top left corner and proceeding from left to right across the rows;

wherein the whole numbers are arranged in three groups of twenty numbers each, a first group comprising the numbers 1 through 20, a second group comprising the numbers 21 through 40 and a third group comprising the numbers 41 through 60; and wherein each of the first, second and third group comprise five even numbers associated with the first color, five odd numbers associated with the first color, five even numbers associated with the second color and five odd numbers associated with the second color;

c) arranging indicia indicating the one or more house numbers on the roulette wheel; and d) arranging indicia indicating each of the sixty whole numbers on the roulette wheel in a circumferential manner by:

selecting a first whole number associated with the first color and selecting a second whole number associated with the second color, the first and second whole numbers disposed in a first column of the five columns and disposed in a first group of the three groups, and indicating the first whole number and second whole number as adjacent numbers on the roulette wheel;

selecting a first further whole number associated with the first color and selecting a first further whole number associated with the second color, the first further whole number of the first color and first further whole number of the second color disposed in a second column of the five columns and disposed in a second group of the three groups, and indicating the first further whole number of the first color and first further whole number of the second color as adjacent numbers on the roulette wheel adjacent to one of: the first whole number or second whole number; and, selecting a second further whole number associated with the first color and selecting a second further whole number associated with the second color, the second further whole numbers of first and second colors disposed in a third column of the five columns and disposed in a third group of the three groups, and indicating the second further whole number of the first color and second further whole number of the second color as adjacent numbers on the roulette wheel adjacent to one of the first further whole number of the first or second color;

selecting a third further whole number associated with the first color and selecting a third further whole number associated with the second color, the third further whole numbers of first and second colors disposed in a fourth column of the five columns and disposed in the first group of the three groups, and indicating the third further whole number of the first color and third further whole number of the second color on as adjacent numbers the roulette wheel adjacent to one of the second further whole number of the first or second color;

selecting a fourth further whole number associated with the first color and selecting a fourth further whole number associated with the second color, the fourth further whole numbers of first and second colors disposed in a fifth column of the five columns and disposed in the second group of the three groups, and indicating the fourth further whole number of the first color and fourth further whole number of the second color as adjacent numbers on the roulette wheel adjacent to one of the third further whole number of the first or second color; and repeating a first pattern on the roulette wheel such that one pair of adjacent non-house numbers on the roulette wheel are in a same group and same column on said game surface, and each successive pair of adjacent non-house numbers proceeding in a first direction on the roulette wheel from said one pair are in a same group and same column on said game surface;

repeating a second pattern on the roulette wheel such that no two adjacent non-house numbers on the roulette wheel are associated with a same color, are disposed in a same row on the game surface, and are disposed adjacent one another on the game surface; and, repeating a third pattern on the roulette wheel such that a first pair of adjacent non-house numbers on the wheel are both odd numbers and a second pair of non-house numbers adjacent the first pair are both even numbers, and successive alternating first pairs of two adjacent non-house numbers on the wheel proceeding in a first direction are odd; and successive alternating second pairs of two adjacent non-house numbers on the wheel proceeding in the first direction between each the successive alternating first pairs proceeding in the first direction are even.

Further to this embodiment, the method comprises further arranging said whole numbers on the roulette wheel such that:

a third pair of adjacent non-house numbers on the wheel sum to 61, and, a fourth pair of non-house numbers on the wheel located substantially diametrically opposite said third pair of adjacent numbers on said wheel sum to 61, and such that:

a first non-house number immediately adjacent one number of said third pair indicated on the wheel in a first direction, and, a corresponding second non-house number immediately adjacent the other number of said third pair indicated on the wheel in a second direction sum to 61; and, repeating a fourth pattern on the wheel such that, each successive non-house whole number on said wheel proceeding in said first direction between said first non-house number and said fourth pair of non-house numbers and a corresponding successive non-house whole number on said wheel proceeding in said second direction from said second non-house number and said fourth pair of non-house numbers sum to 61.

Further to this embodiment, each non-house whole number and a corresponding non-house whole disposed substantially diametrically opposite said non-house whole number are adjacent each other in a single column disposed in one of said first, second, or third groups.

Further to this embodiment, each non-house whole number and a corresponding non-house whole disposed substantially diametrically opposite said non-house whole number are the same color.

Further to this embodiment, as with the other roulette wheels, the house numbers can separate any two numbers. However, if the number of house numbers are even or if the number of non-house numbers are divisible by the number of house numbers, then the house numbers are arranged in a symmetrical fashion on the roulette wheel. For example, if there are three house numbers, they are provided on the wheel evenly distributed about the circumference of said wheel such that 20 non-house numbers are present between any two house numbers.

Further to this embodiment, the roulette wheel numbers are arranged in the following clockwise sequence: an optional house number, 55, 45, 24, 34, 13, 3, 42, 52, 31, 21, 20, 10, 49, 59, 38, 28, 7, 17, 56, 46, an optional house number, 35, 25, 4, 14, 53, 43, 22, 32, 11, 1, 60, 50, 29, 39, 18, 8, 47, 57, 36, 26, an optional house number, 15, 5, 44, 54, 33, 23, 2, 12, 51, 41, 40, 30, 9, 19, 58, 48, 27, 37, 16, 6. If there are three house numbers, they are distributed evenly around the wheel, for example, in an embodiment, between 55 and 6, 46 and 33 and 26 and 15.

In a further aspect, there is provided a roulette game apparatus comprising:

a) a game surface comprising:

(i) one or more house number wagering areas;

(ii) an even number wagering area;

(iii) an odd number wagering area;

(iv) a first color wagering area;

(v) a second color wagering area;

(vi) a low number wagering area corresponding to a whole number from 1 to 30;

(vii) a high number wagering area corresponding to a whole number from 31 to 60;

(viii) a first other wagering area corresponding to a whole number from 1 to 20;

(ix) a second other wagering area corresponding to a whole number from 21 to 40;

(x) a third other wagering area corresponding to a whole number from 41 to 60; and (xi) sixty individual number wagering areas, each corresponding to a whole number from 1 to 60, the sixty individual number wagering areas arranged in ascending order in a matrix of five columns and twelve rows and in three groups of twenty numbers each, a first group comprising the numbers 1 through 20, a second group comprising the numbers 21 through 40 and a third group comprising the numbers 41 through 60; wherein individual number wagering areas corresponding to numbers 1, 3, 5, 6, 8, 10, 12, 14, 17, 19, 21, 23, 25, 26, 28, 30, 32, 34, 37, 39, 41, 43, 45, 46, 48, 50, 52, 54, 57 and 59 are associated with the first color, and individual number wagering areas corresponding to numbers 2, 4, 7, 9, 11, 13, 15, 16, 18 20, 22, 24, 27, 29, 31, 33, 35, 36, 38, 40, 42, 44, 47, 49, 51, 53, 55, 56, 58 and 60 are associated with the second color; and b) a roulette wheel comprising a plurality of pockets disposed in a circumferential manner, each of the pockets corresponding to a house number or to a whole number from 1 to 60, wherein each of the whole numbers is associated with the first color or the second color as on the game surface, and wherein the pockets are arranged on the roulette wheel such that:

one pair of adjacent non-house numbers on the roulette wheel are in a same group and same column on the game surface, and successive pairs of adjacent non-house numbers on the roulette wheel are in a same group and same column on the game surface, and, no two adjacent numbers on the roulette wheel are associated with a same color, are disposed in a same row on the game surface, or are disposed adjacent one another on the game surface; and, a first pair of adjacent non-house numbers on the wheel are both odd numbers and a second pair of non-house numbers adjacent the first pair are both even numbers, and successive alternating first pairs of two adjacent non-house numbers on the wheel proceeding in a first direction are odd; and successive alternating second pairs of two adjacent non-house numbers on the wheel proceeding in the first direction between each the successive alternating first pairs proceeding in the first direction are even.

Advantageously, the method for arranging indicia on a Balanced Roulette Wheel and Balanced Super Roulette Wheel game surface and on an associated Balanced Wheel and Balanced Super Roulette Wheel game surfaces that reduce the impact of wheel Bias that affects payouts for multi-number bets (e.g., 4-number bets or more).

An advantage of a method for arranging indicia on a Balanced roulette game surface and on an associated Balanced roulette wheel and of roulette game apparatuses according to embodiments of the invention is that the relationships between adjacent numbers on the prior art roulette wheel and their corresponding characteristics and positions on the prior art game surface are eliminated or minimized. The game surface and Balanced roulette wheel arrangements according to embodiments of the invention minimizes the effect of the second bias associated with the wheel that affects groups of numbers such that players using are unable to take advantage of the relationship between the positions of the numbers on the prior art roulette wheel and the betting combinations available on the prior art game surface to increase their odds of winning.

The game surface and wheel arrangements according to embodiments of the invention achieve fairness, balance and consistency for the player and casino by providing a perfect balance of red, black, odd and even numbers on the game surface and a roulette wheel layout which is matched to a corresponding game surface or board to eliminate relationships between groups of numbers on the wheel and betting arrangements on the game surface and further minimizes the effect of any bias associated with the wheel that affects groups of numbers.

A further advantage of a super roulette wheel arrangement according to a method and apparatus of the invention is that an arrangement may be provided that is adaptable for both American and European use with a common game surface have substantially the same arrangement of numbers. This feature may increase player interest, as players familiar with one of the American or European roulette wheel arrangement will also be easily familiarized with the other style wheel.

BRIEF DESCRIPTION OF THE DRAWINGS

Other benefits and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements:

FIG. 1 shows a prior art game surface for a Standard American roulette game;

FIG. 1A shows a prior art Standard American wheel arrangement for a use with the prior art game surface shown in FIG. 1;

FIG. 1B shows a prior art European wheel arrangement for a use with the prior art game surface shown in FIG. 1;

DETAILED DESCRIPTION OF THE PREFERRED EMBODIMENTS

Figure 2:
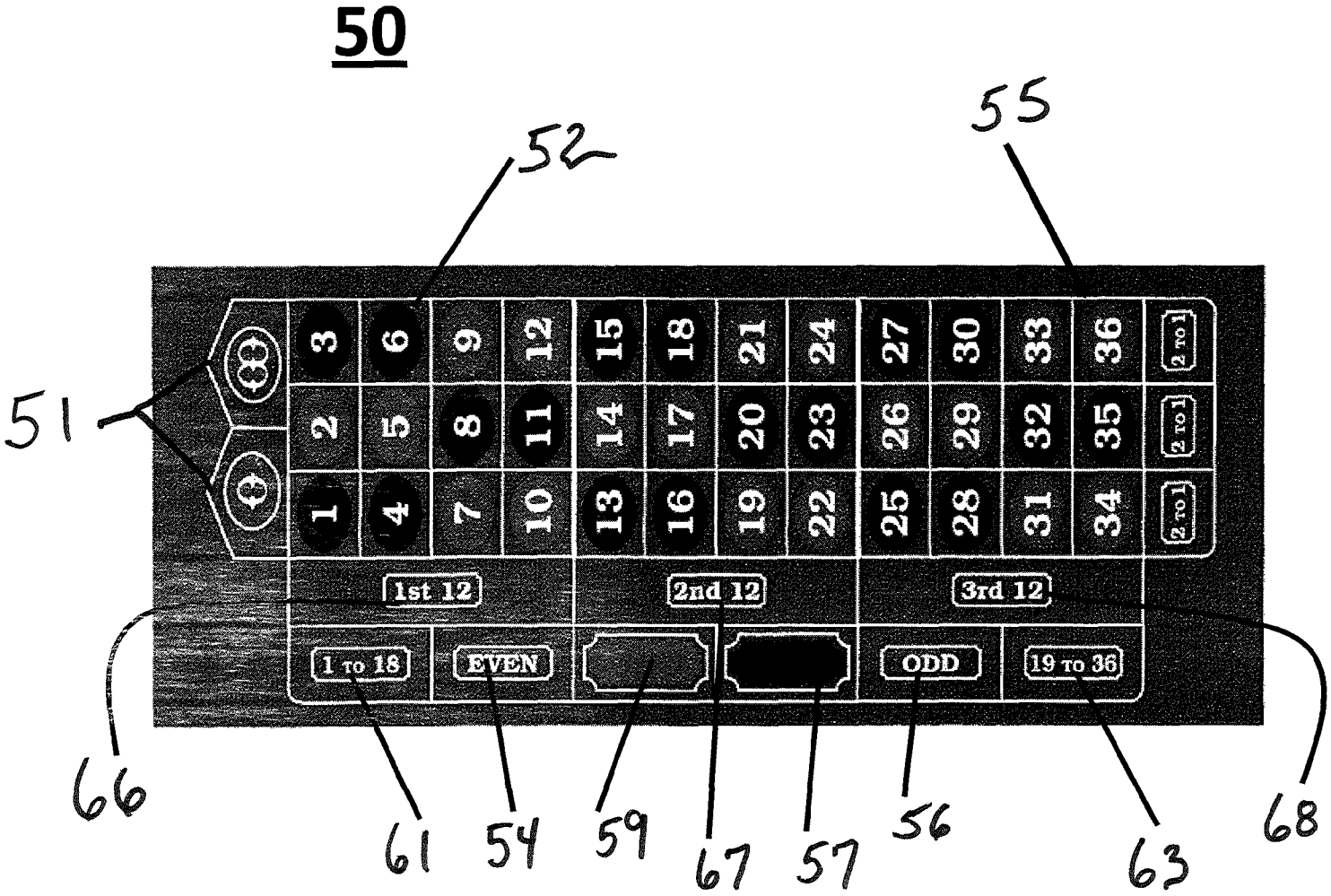
FIG. 2 shows a Balanced roulette game surface according to an embodiment of the invention.

In the drawings, numbers and symbols in regular typeface indicate a first color, for example red. Numbers and symbols in bold typeface indicate a second color, for example black. Numbers in an outline type format indicate a third color, for example green.

A first embodiment of the present application refers to a "Balanced" roulette wheel apparatus containing 36 whole numbers thereon that ameliorates and at best eliminates effects of bias due to an overall imbalance or asymmetry in the wheel's rotation (which affects multiple numbers at a time in affected "regions" on the wheel surface).

Balanced Roulette Wheel

As used herein, the terms "substantially diametrically opposite", "substantially diametrically opposed and "substantially diametrically" are synonymous and mean that the numbers on the roulette wheel are separated by the number of non-house number on the roulette wheel divided by two ±1 non-house numbers. For example, in the roulette wheel of 36 non-house numbers, if the roulette wheel contains two house numbers which are "substantially diametrically opposite", this means that the two house numbers are separated by 18±1 house numbers, e.g., 18 non-house numbers. In the wheel of 60 non-house numbers, if the roulette wheel contains two house numbers which are "substantially diametrically opposite", this means that the two house numbers are separated by 30 non-house numbers. It is to be noted that a roulette wheel of 36 non-house numbers, the non-house numbers which are substantially diametrically opposite are separated by 17 non-house numbers. On the other hand, on a roulette wheel of 60 non-house numbers, the non-house numbers which are substantially diametrically opposite are separated by 29 non-house numbers.

The term "group" refers to the division of roulette board into 3 groups. If it contains 36 non-house numbers, Group I is Numbers 1-12, Group 2 contains Numbers 13-24 and the third group contains numbers 25-36. If these roulette wheel contains 60 non-house numbers the first group contains numbers 1-20 the second group contains numbers 21-40, the third group contains numbers 41-60.

Figure 2A:
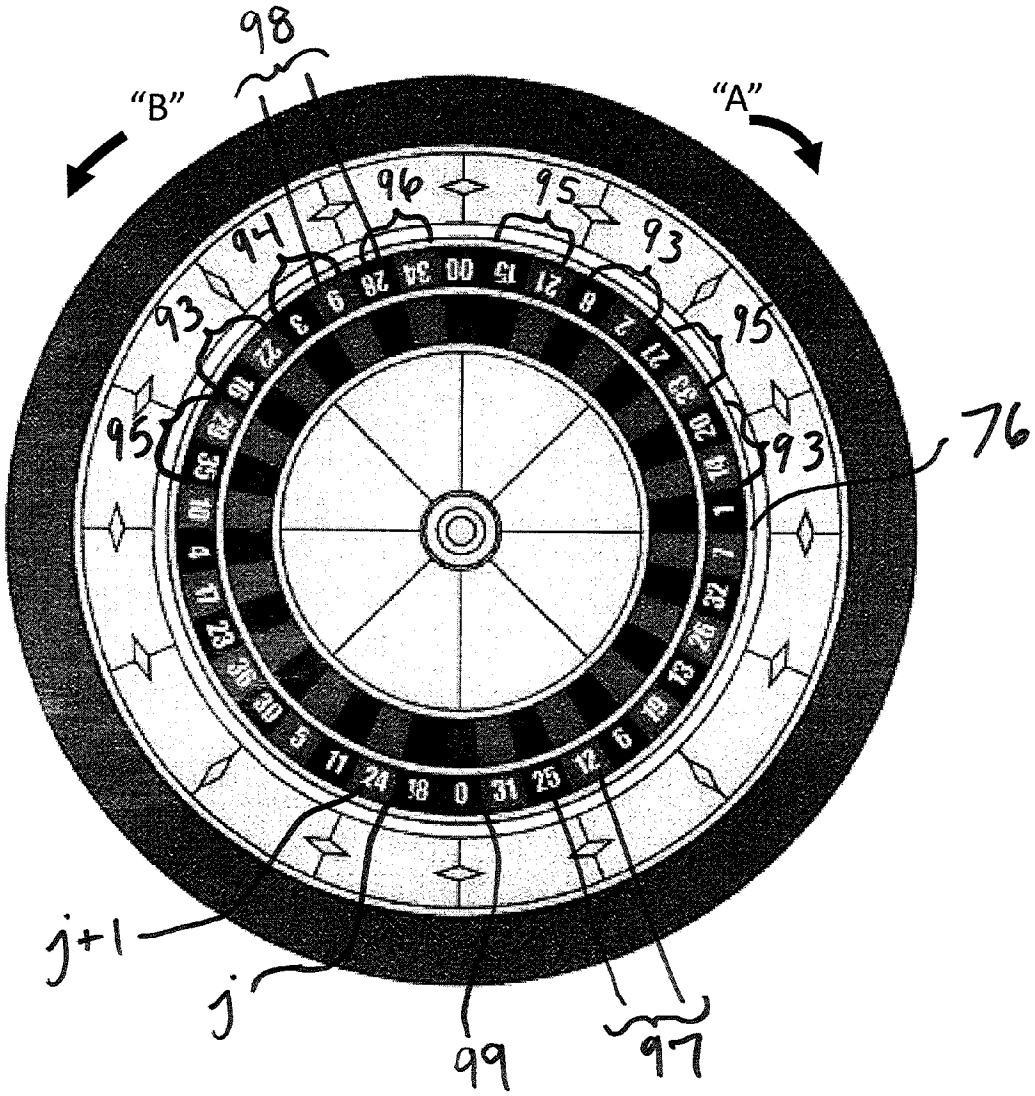
FIG. 2A shows an example Balanced American roulette wheel arrangement for use with the game surface shown in FIG. 2.

In an embodiment of the present invention, as shown in FIGS. 2, 2A, there is provided a Balanced American roulette game apparatus comprising: a) a game surface 50 (FIG. 2) comprising one or more house number wagering areas 51; an even number wagering area 54 for wagering on the even numbers (2, 4, 6, 8, 10, 12, 14, 16, 18, 20, 22, 24, 26, 28, 30, 32, 34, 36); an odd number wagering area 56 for wagering on the odd numbers (1, 3, 5, 7, 9, 11, 13, 15, 17, 19, 21, 23, 25, 27, 29, 31, 33, 35); a first color wagering area 57 (e.g., black) and a second color wagering area 59 (e.g., red) wherein individual number wagering areas 52 corresponding to numbers 1, 3, 4, 6, 8, 11, 13, 15, 16, 18, 20, 23, 25, 27, 28, 30, 32, 35 are associated with the first color (e.g., black), and individual number wagering areas corresponding to numbers 2, 5, 7, 9, 10, 12, 14, 17, 19, 21, 22, 24, 26, 29, 31, 33, 34 and 36 are associated with the second color (e.g., red); a low number wagering area 61 corresponding to a whole number from 1 to 18; a high number wagering area 63 corresponding to a whole number from 19-36; a number of individual number wagering areas 52, each corresponding to a whole number consisting of the numbers from 1 to 36, the 36 individual number wagering areas arranged in ascending order beginning from a top left corner and proceeding from left to right across rows in a matrix 55 of three columns and twelve rows (a 3×12 grid) and in three groups of 12 numbers each, a first group 66 comprising the numbers 1 through 12, a second group 67 comprising the numbers 13-24 and a third group 68 comprising numbers 25-36.

It is noted that in FIGS. 2, 2A, there are specific numbers associated with black and others are associated with red color. In another embodiment, the colors are interchanged, i.e., all numbers associated with black are red, and all numbers associated with red are black.

As shown in FIG. 2, in the game board surface 50 shown, the thirty six individual whole numbers are evenly distributed in a balanced manner wherein nine odd numbers are associated with a first color (for example red), nine odd numbers are associated with a second color (for example black), nine even numbers are associated with a first color (for example red) and nine even numbers are associated with a second color (for example black).

Moreover, each of the three columns in the game surface 50 comprises six numbers associated with the first color and six numbers associated with the second color. For example, each of the columns in the game surface of FIG. 2 comprises six odd numbers and six even numbers. Each of the columns in the game surface of FIG. 2 comprises three even numbers associated with the first color, three even numbers associated with the second color, three odd numbers associated with the first color and three odd numbers associated with the second color.

Additionally, each of the three groups of twelve numbers corresponding to the first, second and third dozen wagering areas 66, 67, 68 in the game surface of FIG. 2 comprises three even numbers associated with the first color, three even numbers associated with the second color, three odd numbers associated with the first color and three odd numbers associated with the second color.

For example, as shown in the game surface 50 illustrated in FIG. 2, individual number wagering areas corresponding to numbers 1, 3, 4, 6, 8, 11, 13, 15, 16, 18, 20, 23, 25, 27, 28, 30, 32 and 35 are associated with a first color (e.g., black), and individual number wagering areas corresponding to numbers 2, 5, 7, 9, 10, 12, 14, 17, 19, 21, 22, 24, 26, 29, 31, 33, 34 and 36 are associated with a second color (e.g., red).

FIG. 2A shows a Balanced American roulette wheel arrangement 75 according to an embodiment of the invention. As shown, the Balanced roulette wheel includes a plurality of pockets 76 disposed in a circumferential manner. For example, the Balanced American style wheel shown in FIG. 2A may have thirty-eight pockets and the Balanced European style wheel shown in FIG. 3A may have thirty-seven pockets.

Each of the pockets 76 correspond to either a house number 0 and 00 for the American wheel (0 for the European wheel) that are evenly spaced apart (diametrically opposed on the periphery of wheel) or, to one of the whole numbers from 1 to 36. Each of the whole numbers on the wheel is associated with a first color or a second color conforming to the association of numbers and colors on a game surface to be used with the particular wheel.

In the Balanced American roulette game apparatus 10 comprising game board surface and roulette wheel embodiments depicted in FIGS. 2, 2A the pockets and corresponding numbers on the roulette wheel are arranged such that no two adjacent numbers on the roulette wheel are associated with a same color, are disposed in a same row on an associated game surface, or are disposed adjacent one another on an associated game surface. In terms of the game surface, two adjacent numbers may be considered as two numbers which are directly above or below one another (for example 4 and 7), side by side (for example 5 and 6) or directly diagonal from one another (for example 10 and 8).

Furthermore, the pockets and corresponding numbers on the Balanced American roulette wheel are arranged such that each pair of numbers disposed "substantially diametrically across" from one another on the roulette wheel is disposed in the same group on the game surface and in the same column on the game surface. The phrase substantially diametrically across from one another refers to two numbers which are disposed on the roulette wheel opposite one another along a diameter of the wheel (or, in the case of 38 number Roulette American Roulette wheel having two (2) house numbers), separated by 17 non-house numbers in succession between. For example, for a 36-number wheel such as shown in FIG. 2A, the following pairs of numbers on the roulette wheel arrangement shown is considered to be disposed substantially diametrically across from one another: 33 and 36; 20 and 23; 14 and 17; 1 and 4; 7 and 10; 32 and 35; 26 and 29; 13 and 16; 19 and 22; 6 and 3; 12 and 9; 25 and 28; 31 and 34; 18 and 15; 24 and 21; 11 and 8; 5 and 2; and 30 and 27. Moreover, a roulette wheel according to this embodiment may be arranged such that all pairs of numbers disposed substantially diametrically across from one another on the roulette wheel are also touching each other on the corresponding game board 50 of FIG. 2.

As shown in FIG. 2A, the Balanced roulette wheel arrangement corresponding to the game board surface 50 shown in FIG. 2, includes pockets arranged in the following clockwise sequence with respect to a corresponding number: an optional house number, 18, 24, 11, 5, 30, 36, 23, 17, 4, 10, 35, 29, 16, 22, 3, 9, 28, 34, an optional house number, 15, 21, 8, 2, 27, 33, 20, 14, 1, 7, 32, 26, 13, 19, 6, 12, 25 and 31. The Balanced European Roulette game is identical to the United States version except for the absence of a house number (e.g., 00).

A method of arranging the thirty-six whole numbers (indicia) on the roulette wheel in a circumferential manner according to one embodiment of the invention is by: selecting a first whole number associated with the first color (e.g., black 25) and selecting a second whole number associated with the second color (e.g., red 31), the first and second whole numbers being disposed in a single column (e.g., first column) of the three columns on the game board and disposed in a third group of the three groups (e.g., $3^{rd}$ group), and indicating the first whole number and second whole number on the roulette wheel. Then, there is further selected a first further whole number associated with the first color (e.g., black 18) and selecting a first further whole number associated with the second color (e.g. red 24), the first further whole number of the first color and first further whole number of the second color disposed in a single column (e.g., third column) of the three columns and disposed in a second group of the three groups (e.g., $2^{nd}$ group), and indicating the first further whole number of the first color and first further whole number of the second color on the roulette wheel adjacent to one of: the first whole number or second whole number. Then, there is selected a second further whole number associated with the first color (e.g., black 11) and selecting a second further whole number associated with the second color (e.g. red 5), the second further first and second whole numbers disposed in a single column (e.g., second column) of the three columns and disposed in a third group of the three groups (e.g., $1^{st}$ group), and indicating the second further whole number of the first color and second further whole number of the second color on the roulette wheel adjacent to one of the first further whole number of the first or second color. This selection of two numbers of different colors from each column/group combination is repeated as a first pattern on the Balanced roulette wheel of FIG. 2A such that no two adjacent non-house numbers on the roulette wheel are associated with a same color, are disposed in a same row on the game surface, and are disposed adjacent one another on the game surface 50 of FIG. 2.

That is, in Balanced roulette wheel arrangement shown in FIG. 2A, a first whole number associated with the first color, (e.g., black 25), and second whole number associated with the second color (e.g., red 31), at adjacent first and second pocket locations at the periphery of the wheel corresponds to locations in Group 3, Col. 1 of the corresponding game surface board 50 of FIG. 2 taken from left to right; the next selected first further whole number associated with the first color (e.g., black 18) and first further whole number associated with the second color (e.g. red 24) at adjacent pocket locations at the periphery of the wheel corresponds to locations in Group 2, Col. 3 of the corresponding game surface board 50 of FIG. 2. The next selected second further whole number associated with the first color (e.g., black 11) and second further whole number associated with the second color (e.g. red 5) at adjacent pocket locations at the periphery of the wheel corresponds to locations in Group 1, Col. 2 of the corresponding game surface board 50 of FIG. 2. Continuing, a next selected (third) further whole number associated with the first color (e.g., black 30) and third further whole number associated with the second color (e.g. red 36) at adjacent pocket locations at the periphery of the wheel corresponds to locations in Group 3, Col. 2 of the corresponding game surface board 50 of FIG. 2. As shown in FIG. 2A, the selection of two consecutive adjacent $j^{th}$ and $j^{th}+1$ pocket number values at each consecutive adjacent (paired) locations starting from first house number location 99 in FIG. 2A, and traversing clockwise, conform to a repeating pattern of Group and Columns of the corresponding game board surface 50 of FIG. 2, from left to right as follows:

| GROUP | Col |
|---|---|
| 3 | 1 |
| 2 | 3 |
| 1 | 2 |
| 3 | 3 |
| 2 | 2 |
| 1 | 1 |
| 3 | 2 |
| 2 | 1 |
| 1 | 3 |
| 3 | 1 |
| 2 | 3 |
| 1 | 2 |
| . | . |
| . | . |
| . | . |

It is further understood that, in this method, the first two selected first whole (non-house) number associated with the first color and selected second whole number associated with the second color may be selected from any group or column, as long as the repeating pattern conforms to the Group and Columns of the corresponding game board surface 50 as shown above.

In the repeating pattern of the embodiment described, it is noted that each selected first whole number, first further whole number and second further whole numbers associated with the first color (e.g., black 25, 18, 11, 30 . . . ) are disposed 6 numbers apart on the game surface from the corresponding respective selected second whole number, first further whole number, and second further whole number associated with the second color (e.g., red 31, 24, 5, 36 . . . ).

In this embodiment, the whole numbers on the Balanced American roulette wheel are being selected and arranged such that: a first pair 98 of adjacent non-house numbers (e.g., numbers 28 black, 9 red) on the wheel sum to 37, and, a second pair 97 of adjacent non-house numbers (e.g., numbers 25 black, 12 red) on the wheel located substantially diametrically opposite the first pair of adjacent numbers on the wheel sum to 37, and such that: a first non-house number (e.g., 34 red) immediately adjacent one number (e.g., 28) of the first pair 98 indicated on the wheel in a first clockwise (CW) direction labeled "A", and, a corresponding positioned second non-house number (e.g., 3 black) immediately adjacent the other number (e.g., 9) of the first pair (i.e., in corresponding like position) indicated on the wheel in a second counterclockwise (CCW) direction labeled "B" sum to 37. Thus, a second pattern is repeated on the wheel such that, each successive non-house whole number on the wheel proceeding in the first CW direction "A" between the first non-house number (e.g., 34 red) and the second pair 97 of adjacent numbers (e.g., numbers 15, 21, 8, 2, 27, 33, 20, 14, 1, 7, 32, 26, 13, 19, 6) and a corresponding like-positioned successive non-house whole number on the wheel proceeding in the second counterclockwise (CCW) direction "B" from the second non-house number (e.g., 3 black) and the second pair 97 of adjacent numbers (e.g., numbers 22, 16, 29, 35, 10, 4, 17, 23, 36, 30, 5, 11, 24, 18, 31) sum to 37.

In the Balanced Roulette wheel arrangement of FIG. 2A a further pattern is repeated such that the first non-house number (e.g., 28) of the first pair 98 and the immediately adjacent first non-house number in the CW direction "A" (e.g., 34) are both even numbers and form an even number pair 96, and, the other number of the first pair (e.g., 9) and the immediately adjacent second non-house number in the CCW direction "B" (e.g., 3) are both odd numbers and form an odd number pair 94, and, proceeding in a clockwise direction from the even number pair 96, such that a third pair 95 of adjacent non-house numbers (e.g., 15, 21) immediately adjacent the immediately adjacent first non-house number (e.g., red 34) in the CW "A" direction are both odd numbers, and a next pair 93 of adjacent non-house numbers (e.g., 8, 2) immediately adjacent the third pair 95 in the CW "A" direction on the wheel are both even numbers, and this pattern is repeated on the wheel such that successive alternating third pairs 95 of two adjacent non-house numbers (e.g., (21, 33), (1, 7), (13, 19), (25, 31), (11, 5), (23, 17), (35, 29)) on the wheel proceeding in the CW direction "A" between the next pair 93 and the immediately adjacent second non-house number (e.g., black 3) are odd; and successive alternating next pairs 93 of two adjacent non-house numbers on the wheel (e.g., (20, 14), (32, 26), (6, 12), (18, 24), (30, 36), (4, 10), (16, 22) proceeding in the CW direction "A" between each the successive alternating third pairs 95 are even.

Further, according to Balanced American roulette wheel arrangement shown in FIG. 2A, the numbers are selected such that a non-house whole number and a corresponding non-house whole disposed substantially diametrically opposite said non-house whole number are adjacent each other in a single column disposed in one of said first, second, or third groups. This is exemplified by at least the following diametrically opposed pairs of non-house numbers (2, 5), (22, 19), (25, 28), etc.

Further, according to Balanced wheel arrangement shown in FIG. 2A, a non-house whole number and a corresponding non-house whole disposed substantially diametrically opposite said non-house whole number are the same color. This is exemplified by at least the following diametrically opposed pairs of non-house numbers (2, 5), (22, 19), (25, 28), etc.

The sequence of numbers on the Balanced European style roulette wheel is substantially the same as the sequence of numbers on a Balanced American style wheel such as shown in FIG. 2A, for use with the same game surface 50 shown in FIG. 2. For example, the sequence of numbers on the Balanced American style wheel shown in FIG. 2A is substantially the same as the sequence on the European style wheel. The only difference in the pairs of wheels is the placement of the additional house number (00) in the Balanced American style wheel shown diametrically opposite first house number 99.

The Balanced American Roulette Wheel has two house numbers, which are located opposite one another. There are 18 non-house numbers separating them, but the house numbers can be placed anywhere on the roulette wheel. However, in one embodiment, the house numbers are placed on the roulette wheel so as it not break up a pair in the same group. Thus, for example, in FIG. 2A it is noted that a pair of the same group is (25, 31), (18, 24), (11, 5), (30, 36), (23, 17), (4, 10), (25, 29), (16, 22), (3, 9), (28, 34), (15, 21), (8, 2), (21, 33), (20, 14), (1, 7), (32, 26), (13, 19), and (6, 12). The house number, in this embodiment, cannot break up a pair, but a house number can be placed between each pair. For example, in FIG. 2A, the house number "0" is between (25, 31) and (18, 24) and another house number "00" is placed between (28, 34) and (21, 15). The house number, however, can not be placed, in this embodiment between 25 and 31, or between 8 and 24, or between 28 and 34 or between 21 and 15, for then it would then break up a group.

Further, in an embodiment, the house numbers are arranged so that one group of the pattern is on one side and the other two groups of the pattern are on the other side of the house number. For example, in FIG. 2A (25, 31) are in group 3, (18, 24) is Group 2, and (11, 5) is in Group 1. Thus, to the left of the house number "0", is one group of the pattern (Group 3) and to the right of the 0 is two groups of the pattern (Groups 1 and 2) and depicted above. Similarly for, 00, it is noted that around 00, on the right side of 00 are (34, 28), and on the left side are (15, 21) and (8, 2); then on the left side is group 3, and on the right side, are the other two groups of the pattern, Groups 2 and 1. In another embodiment, the house number is placed such that it is not between pairs and such that it does not split the pair, so that one group of the pattern is on one side of the house number and the other two groups of the pattern are on the other side of the house number.

The same is true with the European wheel. It has only one house number. In one embodiment as in the American wheel, the house number is placed so as to not to break up the pair. In this embodiment, it is placed between pairs. Further, in another embodiment, it is placed such that one group of the pattern is on one side of the house number and the other two groups are on the other side of the house number. In another embodiment, the house number is placed so that it does not break up a pair and such that one group of the pattern is on one side of the house number and the other two groups of the pattern is on the other side of the house number.

In demonstrating the advantageous effect of the Balanced Roulette wheel embodiment with respect to a physical bias that may affect regions of numbers, the Roulette wheel was modeled and various multi-number type bets of the types described herein, simulated using the model. To model this, it is assumed that the Roulette wheel is biased in a way that makes one half of the wheel more likely and the other half less likely. Thus, it is assumed that within each half, the probabilities of all numbers are equal. (In the case of a European wheel with an odd number of compartments, the boundary between the more likely and less likely halves passes through the middle of one of the compartments, which is assumed to be unbiased.)

For each multi-number bet, the distribution of the numbers between the "heavy half" and the "light half" of the wheel was calculated, averaging over all bets and all ways of splitting the wheel into two halves, for the Standard Roulette wheel layout (shown in FIG. 1A) and Balanced American Roulette wheel layout shown in FIG. 2A.

First there is enumerated all wheel bias possibilities, e.g., the possible ways of dividing a roulette wheel in half (e.g., 37 different ways for the standard roulette), then for each (multi-number) bet, counting how many numbers end up in ½ of the wheel e.g. a "light" half, and how many numbers end up in a "heavy" half, for the wheel described herein in FIG. 2A. Actual numbers could be generated using a random number generator and results obtained using combinatorics.

There are six even-money (18-number) bets and six 2:1 (12-number) bets on the table layout: with Even money bets corresponding to a bet of: a Red number, Black number, Even number, Odd number, first group numbers 1-18, and second group numbers 19-36 and the six 2:1 bets comprising:

$1^{st}$ box=1-12;

$2^{nd}$ box=13-24;

$3^{rd}$ box=25-36;

$1^{st}$ column=1, 4, 7, 10, 13, 16, 19, 22, 25, 28, 31, 34;

$2^{nd}$ column=2, 5, 8, 11, 14, 17, 20, 23, 26, 29, 32, 35;

$3^{rd}$ column=3, 6, 9, 12, 15, 18, 21, 24, 27, 30, 33, 36

In the following Tables below, the indicated percentages refer to the probability that, when the wheel is biased, the numbers involved in the bet will be split between the "heavy" and "light" halves of the wheel (e.g., standard American) as indicated. Thus, for even money bets (18 numbers), an indicated 9:9 split means that the wheel's bias does not affect the return of the bet. For 2:1 bets (12 numbers), a 6:6 split indicated in the table means that the wheel's bias does not affect the return of the bet.

For example, as follows, shown in Table IA, the model simulation produces the following "Average" over all even number bets (i.e., 18 numbers, including betting on black or red) for the standard American Roulette wheel depicted in FIG. 1A (and the standard European Roulette wheel depicted in FIG. 1B), and shown in Table IB, the model simulation produces the following "Average" over all even number bets (i.e., 18 numbers) for the Balanced American Roulette wheel depicted in FIG. 2A (and the Balanced European wheel (not shown) which differs from the Balanced American wheel by eliminating one house number):

TABLE IA

| | numbers in "heavy" half of wheel | | | | |
|---|---|---|---|---|---|
| Standard | 7 | 8 | 9 | 10 | 11 |
| American | 3.51% | 15.79% | 61.40% | 15.79% | 3.51% |
| European | 0.45% | 24.32% | 67.12% | 8.11% | 0.00% |

TABLE IB

| | numbers in "light" half of wheel | | | | |
|---|---|---|---|---|---|
| Balanced | 7 | 8 | 9 | 10 | 11 |
| American | 0.00% | 8.77% | 82.46% | 8.77% | 0.00% |
| European | 0.00% | 21.17% | 74.77% | 4.05% | 0.00% |

For example, as follows, shown in Table IIA, the model simulation produces the following "Average" over all 2:1 bets (i.e., 12-number bets) for the standard American Roulette wheel depicted in FIG. 1A (and the standard European Roulette wheel depicted in FIG. 1B), and shown in Table IIB, the model simulation produces the following "Average" over all 12-number bets for the Balanced American Roulette wheel depicted in FIG. 2A (and the Balanced European wheel (not shown) which differs from the Balanced American wheel by eliminating one house number):

TABLE IIA

| | numbers in "light" half of wheel | | | | | | | | |
|---|---|---|---|---|---|---|---|---|---|
| Standard | 2 | 3 | 4 | 5 | 6 | 7 | 8 | 9 | 10 |
| American | 2.63% | 1.75% | 4.39% | 7.02% | 68.42% | 7.02% | 4.39% | 1.75% | 2.63% |
| European | 0.00% | 0.00% | 2.25% | 29.73% | 51.35% | 16.22% | 0.45% | 0.00% | 0.00% |

TABLE IIB

| | numbers in "heavy" half of wheel | | | | | | | | |
|---|---|---|---|---|---|---|---|---|---|
| Balanced | 2 | 3 | 4 | 5 | 6 | 7 | 8 | 9 | 10 |
| American | 0.00% | 0.00% | 0.00% | 0.00% | 100.00% | 0.00% | 0.00% | 0.00% | 0.00% |
| European | 0.00% | 0.00% | 0.00% | 17.12% | 82.88% | 0.00% | 0.45% | 0.00% | 0.00% |

From these example simulation results, shown in Tables IA, IB, IIA, JIB it is clear that the "Balanced" layouts are less likely to have many numbers in the "heavy" half of the wheel, and more likely to be evenly split so that the return of the bet will be unaffected.

For bets on fewer numbers, there is also an improvement from using the Balanced layout. For example, as follows, shown in Table IIIA, the model simulation produces the following "Average" over all 5:1 bets (6 numbers: there are 11 of these bets, 1-6, 4-9, 7-12, . . . , 31-36) for the standard American Roulette wheel depicted in FIG. 1A (and the standard European Roulette wheel depicted in FIG. 1B), and shown in Table IIIB, the model simulation produces the following "Average" over all 6-number bets for the Balanced American Roulette wheel depicted in FIG. 2A (and the Balanced European wheel (not shown) which differs from the Balanced American wheel by eliminating one house number):

TABLE IIIA

| | numbers in "heavy" half of wheel | | | | |
|---|---|---|---|---|---|
| Standard | 1 | 2 | 3 | 4 | 5 |
| American | 0.00% | 14.83% | 70.81% | 14.35% | 0.00% |
| European | 2.46% | 23.83% | 54.79% | 17.69% | 1.23% |

TABLE IIIB

| | numbers in "light" half of wheel | | | | |
|---|---|---|---|---|---|
| Balanced | 1 | 2 | 3 | 4 | 5 |
| American | 0.00% | 7.89% | 84.96% | 7.42% | 0.00% |
| European | 0.00% | 13.76% | 81.33% | 4.91% | 0.00% |

For example, as follows, shown in Table IVA, the model simulation produces the following "Average" over all 8:1 bets (4 numbers; there are 22 of these bets) for the standard American Roulette wheel depicted in FIG. 1A (and the standard European Roulette wheel depicted in FIG. 1B), and shown in Table IVB, the model simulation produces the following "Average" over all 4-number bets for the Balanced American Roulette wheel depicted in FIG. 2A (and the Balanced European wheel (not shown) which differs from the Balanced American wheel by eliminating one house number):

TABLE IVA

| | numbers in "heavy" half of wheel | | | | |
|---|---|---|---|---|---|
| Standard | 0 | 1 | 2 | 3 | 4 |
| American | 0.00% | 14.83% | 70.81% | 14.35% | 0.00% |
| European | 2.46% | 23.83% | 54.79% | 17.69% | 1.23% |

TABLE IVB

| | numbers in "light" half of wheel | | | | |
|---|---|---|---|---|---|
| Balanced | 0 | 1 | 2 | 3 | 4 |
| American | 0.00% | 5.50% | 89.23% | 5.26% | 0.00% |
| European | 0.00% | 9.58% | 86.61% | 3.81% | 0.00% |

As depicted in the Tables above, it is clear that an advantage of the Balanced Roulette wheel (American and European versions) embodiment depicted in FIGS. 2-2A, the multi-number bets are spread more evenly around the wheel than in standard layouts. This means that their chance of winning will be much less affected by an imbalance in the physical wheel that causes one region of the wheel to be more or less likely than it should be. The multi-number bets will have a more equal division into "heavy" and "light" numbers so the overall odds for the bet will be less affected.

That is, the "Balanced" layouts are less likely to have many numbers in the "heavy" half of the wheel, and more likely to be evenly split so that the return of the bet will be unaffected.

Even when multi-number bets are concentrated in one region of the wheel, it is possible for a badly balanced wheel to cause the odds to unfairly favor the player or the house. However, the balanced layouts in the embodiments of the Balanced Roulette wheel (American and European versions) minimize the potential unfairness.

Balanced Super Roulette Wheel

While the game of roulette has always been restricted to a game having about 36 numbers on the wheel and one or two house numbers designated as 0 or 00 or both, a Balanced Super Roulette wheel and game surface arrangements is provided that is a variation of Roulette played with a wheel having up to 63 compartments labeled with the non-house numbers 1 through 60 and also optional house numbers 0, 00, 000 and 0000 and is played like ordinary Roulette. There is a spinning wheel containing compartments for the numbers 0 through 60 (with optional additional "0", "00" "000" and "0000" compartments), and a ball which rotates around the rim of the wheel until it falls into one of the compartments. There is a table layout which allows the player to place bets on individual numbers or combinations of numbers. On the layout, each number is colored red or black (except, for example, 0, 00, and 000 which are green).

Figure 3:
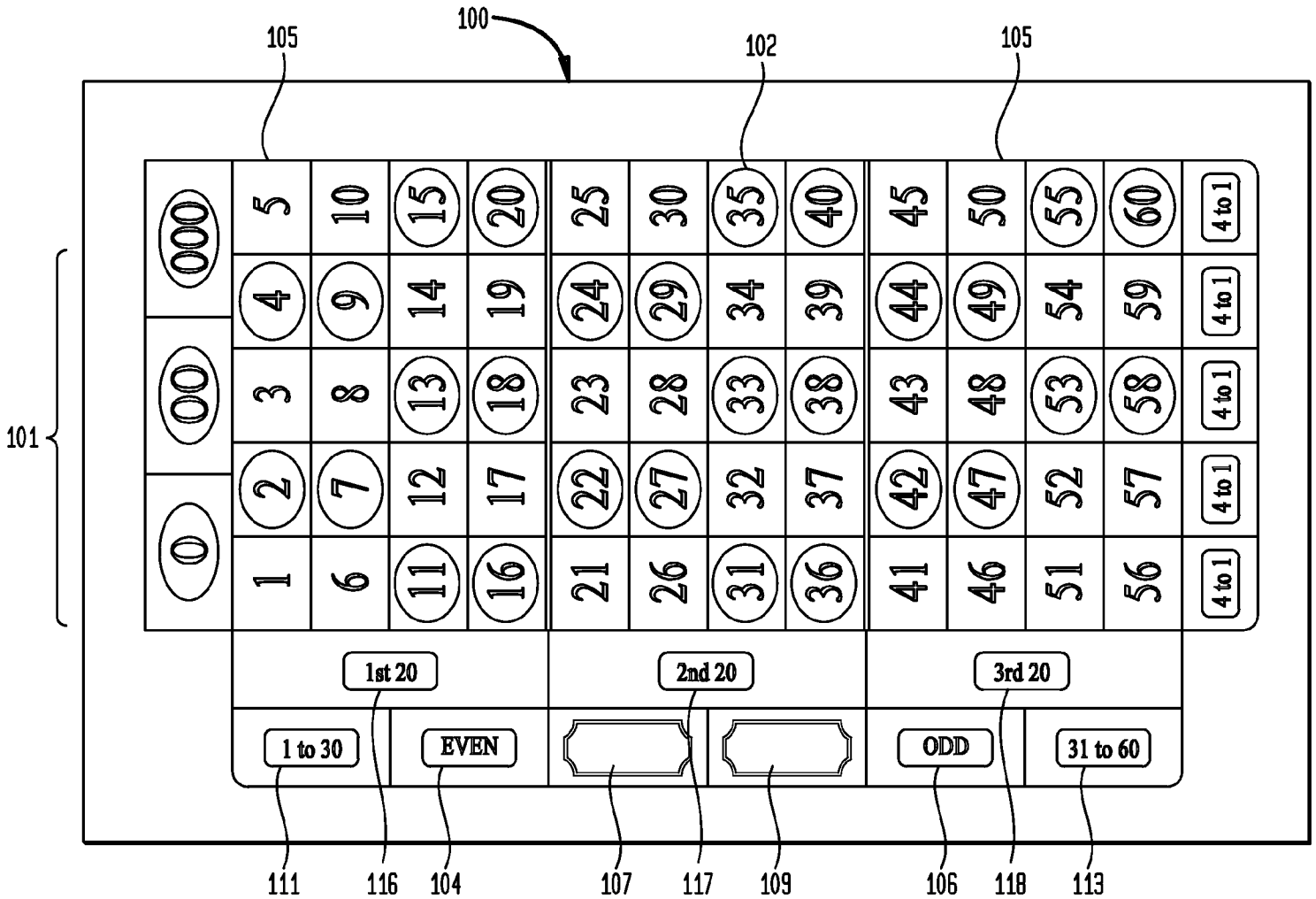
FIG. 3 shows a Balanced Super Roulette game surface according to an embodiment of the invention.

According to a further embodiment of the invention, the Balanced Super roulette game includes a Balanced Super Roulette wheel having 60 whole numbers and a corresponding Balanced Super roulette game board surface indicating 60 individual number wagering areas. As shown in FIG. 3, in this embodiment, the Balanced Super roulette game board surface 100 comprises: one or more house number wagering areas 101; an even number wagering area 104 for wagering on the even numbers (2, 4, 6, 8, 10, 12, 14, 16, 18, 20, 22, 24, 26, 28, 30, 32, 34, 36, 38, 40, 42, 44, 46, 48, 50, 52, 54, 56, 58 and 60); an odd number wagering area 106 for wagering on the odd numbers (1, 3, 5, 7, 9, 11, 13, 15, 17, 19, 21, 23, 25, 27, 29, 31, 33, 35, 37, 39, 41, 43, 45, 47, 49, 51, 53, 55, 57, 59); a first color wagering area 107 for wagering on numbers associated with a first color, for example red; a second color wagering area 109 for wagering on numbers associated with a second color, for example black; a low number wagering area 111 for wagering on whole numbers from 1 to 30; a high number wagering area 113 corresponding to a whole number from 31 to 60 for wagering on whole numbers from 31 to 60; a first other wagering area 116 corresponding to a whole number from 1 to 20 for wagering on whole numbers from 1 to 20; a second other wagering area 117 corresponding to a whole number from 21 to 40 for wagering on whole numbers from 21-40; a third other wagering area 118 corresponding to a whole number from 41 to 60 for wagering on whole numbers from 41 to 60; and sixty individual number wagering areas 102, each corresponding to a whole number from 1 to 60, said sixty individual number wagering areas 102 arranged in ascending order beginning from a top left corner and proceeding from left to right across rows in a matrix 105 of five columns and twelve rows (a 5×12 grid) and in three groups of twenty numbers each, a first group comprising the numbers 1 through 20, a second group comprising the numbers 21 through 40 and a third group comprising the numbers 41 through 60; wherein individual number wagering areas corresponding to thirty of the sixty numbers are associated with the first color, and individual number wagering areas corresponding to the remaining numbers are associated with the second color.

As shown in FIG. 3, in a game surface 100 according to this embodiment of the invention, the sixty individual whole numbers are evenly distributed in a perfectly balanced manner wherein fifteen odd numbers are associated with a first color (for example red), fifteen odd numbers are associated with a second color (for example black), fifteen even numbers are associated with a first color (for example red) and fifteen even numbers are associated with a second color (for example black).

Moreover, each of the five columns in the game board surface 100 according to an embodiment of the invention comprises six numbers associated with the first color and six numbers associated with the second color. Each of the columns in the game surface according to this embodiment of the invention comprises six odd numbers and six even numbers. Each of the columns in a game surface according to an embodiment of the invention comprises three even numbers associated with the first color, three even numbers associated with the second color, three odd numbers associated with the first color and three odd numbers associated with the second color.

Additionally, each of the three groups of twenty numbers corresponding to the first, second and third other wagering areas 116, 117, 118 in the game surface according to an embodiment of the invention comprises five even numbers associated with the first color, five even numbers associated with the second color, five odd numbers associated with the first color and five odd numbers associated with the second color.

For example, as shown in the game surface illustrated in FIG. 3, individual number wagering areas 102 corresponding to numbers 1, 3, 5, 6, 8, 10, 12, 14, 17, 19, 21, 23, 25, 26, 28, 30, 32, 34, 37, 39, 41, 43, 45, 46, 48, 50, 52, 54, 57 and 59 are associated with a first color (e.g., red), and individual number wagering areas corresponding to numbers 2, 4, 7, 9, 11, 13, 15, 16, 18 20, 22, 24, 27, 29, 31, 33, 35, 36, 38, 40, 42, 44, 47, 49, 51, 53, 55, 56, 58 and 60 are associated with a second color (e.g., black).

Figure 3A:
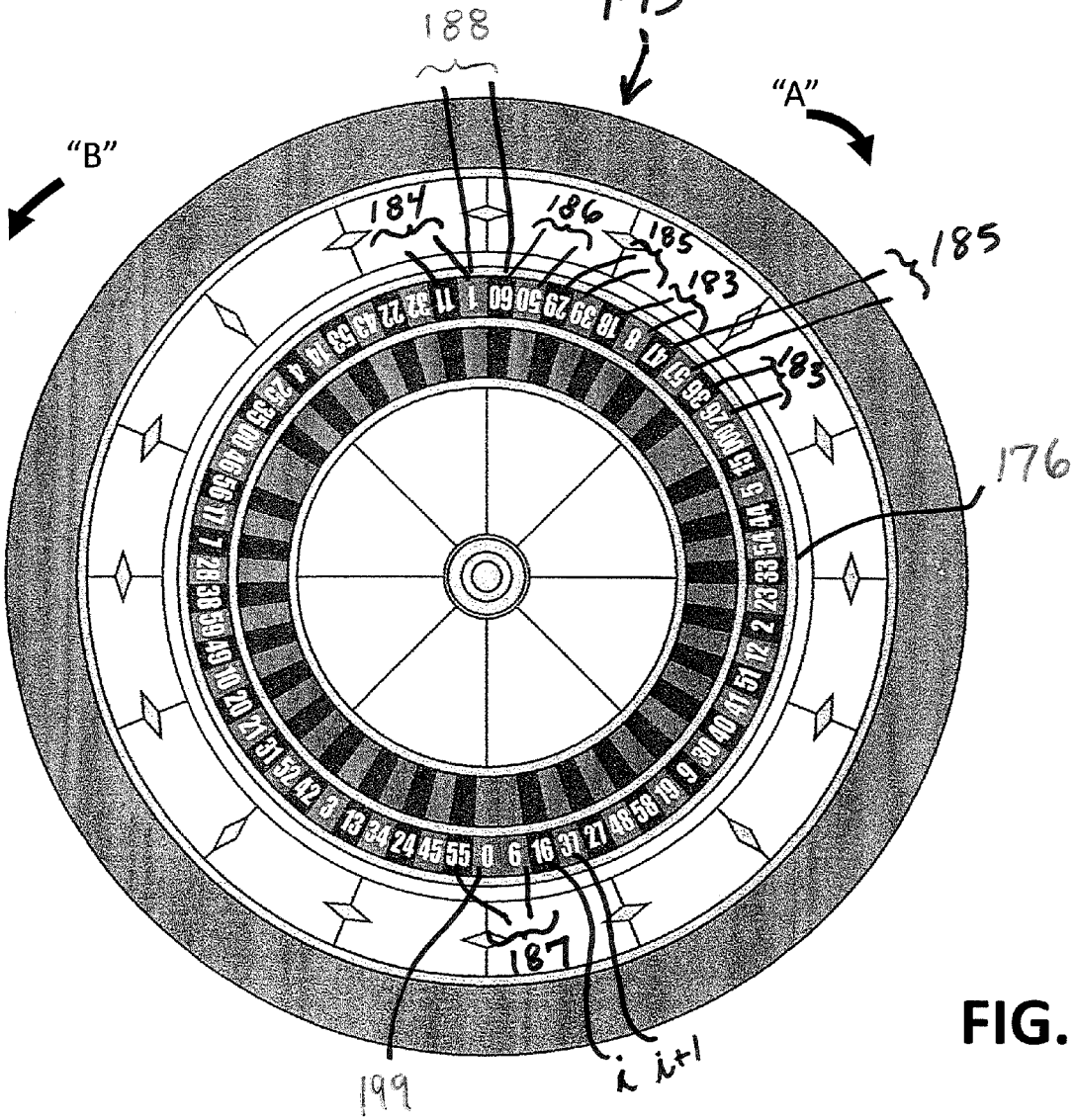
FIG. 3A shows an example Balanced Super Roulette wheel arrangement for use with the game surface shown in FIG. 3.

It is noted that in FIGS. 3, 3A, there are specific numbers associated with black and others are associated with red color. In another embodiment, the colors are interchanged, i.e., all numbers associated with black are red, and all numbers associated with red are black.

Winning wagers in the Balanced Super Roulette wheel game are paid out at predetermined multiples based on the probability of the particular predicted outcome. In the Balanced Super Roulette wheel game, for example, there are six (6) even money bets that pay out at a ratio of 1:1 including a selection of a Red number, a Black number, an Even number, an Odd number, or number groups 1-30 or 31-60; there are three (3) 20-number bets that pay out at 2:1 on a block of twenty consecutive numbers (first twenty numbers 1 to 20), second twenty from 21 to 40 or last twenty for the combination of numbers 41 to 60. Other wager combinations and associated payout ratios may also be used. For example, there are five (5) 12-number bets that pay out at 4:1 (a winning wager for a column (e.g., $1^{st}$ column numbers 1, 6, 11, 16, 21, 26, 31, 36, 41, 46, 51, 56, $2^{nd}$ column numbers 2, 7, 12, 17, 22, 27, 32, 37, 42, 47, 52, 57, $3^{rd}$ column numbers 3, 8, 13, 18, 23, 28, 33, 38, 43, 48, 53, 58, $4^{th}$ column numbers 4, 9, 14, 19, 24, 29, 34, 39, 44, 49, 54, 59 or $5^{th}$ column numbers 5, 10, 15, 20, 25, 30, 35, 40, 45, 50, 55, 60). There are eleven 10-number bets that that pay out at 5:1 (a winning wager for a group of ten adjacent numbers 1-10, 6-15, 11-20, 16-25, 21-30, 26-35, 31-40, 36-45, 41-50, 46-55, 51-60. There are twelve 5-number bets that that pay out at 11:1 (a winning wager for a group of five adjacent numbers 1-5, 6-10, 11-15, 16-20, 21-25, 26-30, 31-35, 36-40, 41-45, 46-50, 51-55, 56-60. There are further forty-four (44) 4-number bets on the table layout that pay out at 14:1 (a winning wager for each combination of four adjacent numbers 1-2-6-7, 2-3-7-8, 3-4-8-9, 4-5-9-10, 6-7-11-12, 7-8-12-13, 8-9-13-14, 9-10-14-15, 11-12-16-17, 12-13-17-18, 13-14-18-19, 14-15-19-20, 16-17-21-22, 17-18-22-23, 18-19-23-24, 19-20-24-25, 21-22-26-27, 22-23-27-28, 23-24-28-29, 24-25-29-30, 26-27-31-32, 27-28-32-33, 28-29-33-34, 29-30-34-35, 31-32-36-37, 32-33-37-38, 33-34-38-39, 34-35-39-40, 36-37-41-42, 37-38-42-43, 38-39-43-44, 39-40-44-45, 41-42-46-47. 42-43-47-48, 43-44-48-49, 44-45-49-50, 46-47-51-52, 47-48-52-53, 48-49-53-54, 49-50-54-55, 51-52-56-57, 52-53-57-58, 53-54-58-59 and 54-55-59-60.

FIG. 3A shows an example Balanced Super Roulette wheel arrangement according to this embodiment of the invention. As shown, the Balanced roulette wheel 175 includes a plurality of pockets 176 disposed in a circumferential manner, for example the wheel shown in FIG. 3A may have sixty-three or sixty-four pockets.

As shown in FIG. 3A, each of the pockets 176 corresponds to either a house number 0, 00, 000 in the embodiment depicted or, to one of the whole numbers from 1 to 60. Each of the whole numbers on the wheel is associated with a first color or a second color conforming to the association of numbers and colors on a game surface 100 of FIG. 3 to be used with the wheel. It should be understood that while three house numbers 0, 00, 000 are shown evenly distributed about the circumference of the wheel in the embodiments depicted in FIG. 3A, it is understood that one or more house numbers may be omitted. Alternately, an additional house number "0000" may be added and evenly distributed with other house numbers about the wheel periphery.

According to this embodiment of the invention, the pockets and corresponding numbers on the Balanced Super roulette wheel 175 are arranged such that no two adjacent numbers on the roulette wheel are associated with a same color, are disposed in a same row on an associated game surface, or are disposed adjacent one another on an associated game surface. In terms of the game surface, two adjacent numbers may be considered as two numbers which are directly above or below one another (for example 4 and 9), side by side (for example 7 and 8) or directly diagonal from one another (for example 10 and 4).

Furthermore, the pockets and corresponding numbers on the Balanced Super roulette wheel 175 are arranged such that each pair of numbers disposed substantially diametrically across from one another on the roulette wheel is disposed in the same group on the game surface and in the same column on the game surface. The phrase substantially diametrically across from one another refers to two numbers which are disposed on the roulette wheel opposite one another along a diameter of the wheel (or, in the case of 60 number Super Roulette wheel (not counting any house numbers) separated by 29 numbers in succession between). For example, for a 60-number wheel such as shown in FIG. 3A, the following pairs of numbers on the roulette wheel arrangement shown is considered to be disposed substantially diametrically across from one another: 1 and 6; 11 and 16; 32 and 37; 22 and 27, 43 and 48 53 and 58, 14 and 19, 4 and 9, 25 and 30, 35 and 40, 46 and 41, 56 and 51, 17 and 12, 7 and 2, 28 and 23, 38 and 33, 59 and 54, 49 and 44, 10 and 5, 20 and 15, 21 and 26, 31 and 36, 52 and 57, 42 and 47, 3 and 8, 13 and 18, 34 and 39, 24 and 29, 45 and 50, and 55 and 60. Moreover, a Balanced roulette wheel according to this embodiment may be arranged such that all pairs of numbers disposed substantially diametrically across from one another on the roulette wheel are also touching each other on the corresponding game board of FIG. 3.

As shown in FIG. 3A, the Balanced Super Roulette wheel arrangement corresponding to the game board surface 100 shown in FIG. 3, includes pockets arranged in the following clockwise sequence with respect to a corresponding number: an optional house number (e.g., 0), 55, 45, 24, 34, 13, 3, 42, 52, 31, 21, 20, 10, 49, 59, 38, 28, 7, 17, 56, 46, an optional house number (e.g., 00), 35, 25, 4, 14, 53, 43, 22, 32, 11, 1, 60, 50, 29, 39, 18, 8, 47, 57, 36, 26, an optional house number (e.g., 000), 15, 5, 44, 54, 33, 23, 2, 12, 51, 41, 40, 30, 9, 19, 58, 48, 27, 37, 16 and 6. Another embodiment is a Super Roulette wheel which is identical to the layout of FIG. 3A except for the absence of one or two or three house numbers (e.g., 00, 000, 0000). Another embodiment is a Super Roulette wheel of FIG. 3A containing two house numbers separated by 30 non-house numbers. Finally, another embodiment is the Super Roulette Wheel of FIG. 3A containing only 1 house number.

A method of arranging the sixty whole numbers (indicia) on the Balanced Super Roulette wheel 175 of FIG. 3A in a circumferential manner according to one embodiment of the invention is by: selecting a first whole (i.e., non-house) number associated with the first color (e.g., black 16) and selecting a second whole (i.e., non-house) number associated with the second color (e.g., red 6), the first and second whole numbers being disposed in a single column (e.g., first column) of the five columns on the game board 100 of FIG. 3 and disposed in a first group of the three groups (e.g., 1st group corresponding to numbers 1-20), and indicating the first whole number and second whole number on the roulette wheel. Then, there is further selected a first further whole number associated with the first color (e.g., black 27) and selecting a first further whole (i.e., non-house) number associated with the second color (e.g. red 37), the first further whole number of the first color and first further whole number of the second color disposed in a single column (e.g., second column) of the five columns and disposed in a second group of the three groups (e.g., 2nd group), and indicating the first further whole number of the first color and first further whole number of the second color on the roulette wheel adjacent to one of: the first whole number or second whole number in the CCW direction. Then, there is selected a second further whole number associated with the first color (e.g., black 58) and selecting a second further whole number associated with the second color (e.g. red 48), the second further first and second whole numbers disposed in a single column (e.g., third column) of the five columns and disposed in a third group of the three groups (e.g., $3^{rd}$ group), and indicating the second further whole number of the first color and second further whole number of the second color on the roulette wheel adjacent to one of the first further whole number of the first or second color in the CCW direction. Then, there is selected a third further whole number associated with the first color (e.g., black 9) and selecting a third further whole number associated with the second color (e.g. red 19), the third further first and second whole (non-house) numbers disposed in a single column (e.g., fourth column) of the five columns and disposed in a first group of the three groups (e.g., 1st group), and indicating the third further whole number of the first color and third further whole number of the second color on the roulette wheel adjacent to one of the second further whole number of the first or second color in the CCW direction. Then, there is selected a fourth further whole number associated with the first color (e.g., black 40) and selecting a fourth further whole number associated with the second color (e.g. red 30), the fourth further first and second whole numbers disposed in a single column (e.g., fifth column) of the five columns and disposed in a second group of the three groups (e.g., 2nd group), and indicating the fourth further whole number of the first color and fourth further whole number of the second color on the roulette wheel adjacent to one of the third further whole number of the first or second color in the CCW direction.

This selection of two numbers of different colors from a column/group combination is repeated as a first pattern on the Balanced roulette wheel such that no two adjacent non-house numbers on the roulette wheel are associated with a same color, are disposed in a same row on the game surface, and are disposed adjacent one another on the game surface.

That is, in Balanced roulette wheel arrangement shown in FIG. 3A, a first whole (non-house) number associated with the first color, (e.g., black 16), and second whole number associated with the second color (e.g., red 6), at adjacent first and second pocket locations at the periphery of the wheel corresponds to locations in Group 1, Col. 1 of the corresponding game surface board 100 of FIG. 3 taken from left to right; the next selected first further whole number associated with the first color (e.g., black 27) and first further whole number associated with the second color (e.g. red 37) at adjacent pocket locations at the periphery of the wheel corresponds to locations in Group 2, Col. 2 of the corresponding game surface board 100 of FIG. 3. The next selected second further whole number associated with the first color (e.g., black 58) and second further whole number associated with the second color (e.g. red 48) at adjacent pocket locations at the periphery of the wheel corresponds to locations in Group 3, Col. 3 of the corresponding game surface board 100 of FIG. 3. Continuing, a next selected (third) further whole number associated with the first color (e.g., black 9) and third further whole number associated with the second color (e.g. red 19) at adjacent pocket locations at the periphery of the wheel corresponds to locations in Group 1, Col. 4 of the corresponding game surface board 100 of FIG. 3. Continuing, a next selected (fourth) further whole number associated with the first color (e.g., black 40) and fourth further whole number associated with the second color (e.g. red 30) at adjacent pocket locations at the periphery of the wheel corresponds to locations in Group 2, Col. 5 of the corresponding game surface board 100 of FIG. 3.

As shown in FIG. 3A, the consecutive adjacent $i^{th}$ and $i^{th}+1$ pocket number values at each consecutive adjacent (paired) locations starting from first house number location 199 in FIG. 3A, and traversing CCW, conform to a repeating pattern of Group and Columns of the corresponding game board surface 100 of FIG. 3, from left to right as follows:

| GROUP | Col. |
|---|---|
| 1 | 1 |
| 2 | 2 |
| 3 | 3 |
| 1 | 4 |
| 2 | 5 |
| 3 | 1 |
| 1 | 2 |
| 2 | 3 |
| 3 | 4 |
| 1 | 5 |
| 2 | 1 |
| 3 | 2 |
| 1 | 3 |
| 2 | 4 |
| 3 | 5 |
| 1 | 1 |
| . | . |
| . | . |
| . | . |

It is further understood that, in this method, the two selected first whole (non-house) number associated with the first color and selected second whole number associated with the second color may be first selected from any group or column, as long as the repeating pattern conforms to the Group and Columns of the corresponding game board surface 100 as shown above.

In the repeating pattern of the embodiment described, it is noted that each selected first whole number, first further whole number, second further whole number, third further whole number and fourth further whole number associated with the first color (e.g., black 16, 27, 58, 9, 40 . . . ) are disposed 10 numbers apart on the game surface from the corresponding respective selected second whole number, first further whole number, second further whole number, third further whole number and fourth further whole number associated with the second color (e.g., red 6, 37, 48, 19, 30 . . . ).

Further to this Balanced Super Roulette embodiment, in view of FIG. 3A, the whole numbers on the Balanced Super roulette wheel are arranged such that: a first pair 188 of adjacent non-house numbers (e.g., numbers 60 black, 1 red) on the wheel sum to 61, and, a second pair 187 of adjacent non-house numbers (e.g., numbers 55 black, 6 red) on the wheel located substantially diametrically opposite the first pair 188 of adjacent numbers on the wheel sum to 61, and such that: a first non-house number (e.g., 50 red) immediately adjacent one number (e.g., 60 black) of the first pair 188 indicated on the wheel in a first clockwise (CW) direction labeled "A", and, a corresponding second non-house number (e.g., 11 black) immediately adjacent the other number (e.g., 1 red) of the first pair 188 (i.e., in corresponding like position) indicated on the wheel in a second counter-clockwise (CCW) direction labeled "B" sum to 61. This second pattern is repeated on the wheel such that, each successive non-house whole number on the wheel proceeding in the first CW direction "A" between the first non-house number and the second pair 187 of adjacent numbers (e.g., numbers 29, 39, 18, 8, 47, 57, 36, 26, 15, 5, 44, 54, 33, 23, 2, 12, 51, 41, 40, 30, 9, 19, 58, 48, 27, 37, 16) and a corresponding individual like-positioned successive non-house whole number on the wheel proceeding in the second counter-clockwise (CCW) direction "B" between the second non-house number and the second pair 187 of adjacent numbers (e.g., numbers 32, 22, 43, 53, 14, 4, 25, 35, 46, 56, 17, 7, 28, 38, 59, 49, 10, 20, 21, 31, 52, 42, 3, 13, 34, 24, 45) sum to 61; and, such that the first non-house number (e.g., 60) of the first pair 188 and the immediately adjacent first non-house number in the CW direction "A" (e.g., 50) are both even numbers and form an even number pair 186, and, the other number of the first pair (e.g., red 1) and the immediately adjacent second non-house number in the CCW direction "B" (e.g., 11) are both odd numbers and form an odd number pair 184, and, such that a third pair 185 of adjacent non-house numbers (e.g., 29, 39) immediately adjacent the immediately adjacent first non-house number in the CW "A" direction are both odd numbers, and a next pair 183 of adjacent non-house numbers (e.g., 18, 8) immediately adjacent the third pair 185 in the CW "A" direction on the wheel are both even numbers, and this pattern is repeated on the wheel such that successive alternating third pairs 185 of two adjacent non-house numbers (e.g., (47, 57), (15, 5), (33, 23), (51, 41), (9, 19), (27, 37), (55, 45), (13, 3), (31, 21), (49, 59), (7, 17), (35, 25), (53, 43)) on the wheel proceeding in the CW direction "A" between the next pair and the immediately adjacent second non-house number (e.g., 11) are odd; and successive alternating next pairs of two adjacent non-house numbers on the wheel (e.g., (36, 26), (44, 54), (2, 12), (40, 30), (58, 48), (16, 6) (24, 34), (42, 52), (20, 10), (38, 28), (56, 46), (4, 14), (22, 32) proceeding in the direction "A" between each the successive alternating third pairs 185 are even.

Further, according to Balanced Super Roulette wheel arrangement shown in FIG. 3A, a non-house whole number and a corresponding non-house whole disposed substantially diametrically opposite said non-house whole number are adjacent each other in a single column disposed in one of said first, second, or third groups of the game board surface 100 of FIG. 3. This is exemplified by at least the following diametrically opposed pairs of non-house numbers (60, 55), (1, 6), (2, 7), etc.

Further, according to Balanced Super Roulette wheel arrangement shown in FIG. 3A, a non-house whole number and a corresponding non-house whole disposed substantially diametrically opposite said non-house whole number are the same color. This is exemplified by at least the following diametrically opposed pairs of non-house numbers (60, 55), (1, 6), (2, 7), etc.

Just as with the Standard balanced Roulette wheel containing 36 numbers, in an embodiment, the house numbers cannot break up a pair. For example, the house numbers do not break up a pair of adjacent non-house numbers on the roulette wheel which are in the same group and the same column on the game surface. For example, as depicted in FIG. 3A, the sequence is (16, 6), 0, (55, 45), that is a pair from Group 2, another pair from Group 1 and another pair from Group 3. The house number is between the pairs, and does not break up the pair. Similarly, the house number "00" in FIG. 3A is between (56, 46), Group 3 and 35, 25, Group 2 and "000" is between (36), 26), Group 2 and (15, 5) Group 1.

For purposes of demonstrating the advantageous effect of the Balanced Super Roulette wheel 175 of FIG. 3A with respect to a physical bias that may affect regions of numbers, the Balanced Super Roulette wheel was modeled and various multi-number type bets of the types described herein, simulated using the model.

For each multi-number bet, the distribution of the numbers between the "heavy half" and the "light half" of the wheel was calculated, averaging over all bets and all ways of splitting the wheel into two halves, for a comparative Super Roulette wheel layout to be described below, and for the Balanced Super Roulette wheel layout shown in FIG. 3A.

Figure 4:
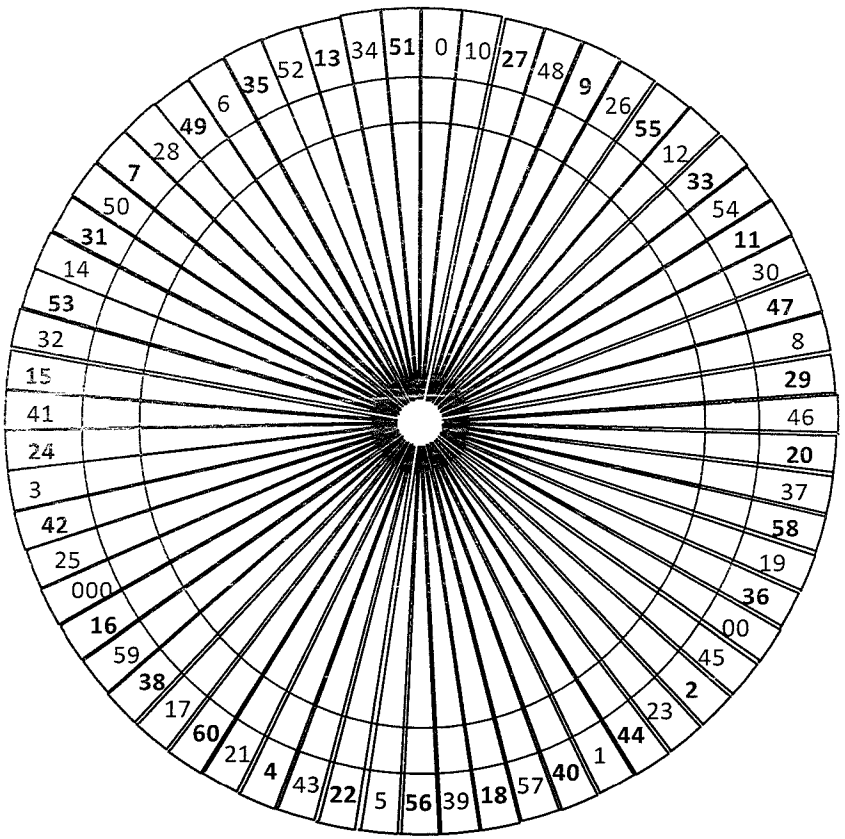
FIG. 4 depicts a "Comparative" Super Roulette wheel layout 200 for purposes of determining an effect of the balanced arrangement of indicia in the Balanced Super Roulette wheel layout of FIG. 3A; and, FIGS. 5A and 5B are charts depicting the average geometric position of each of twelve sets of 5 numbers that can be bet together with FIG. 5A particularly depicting the average geometric position(s) 300 of each of the twelve sets of 5 numbers for the "old" Super Roulette arrangement of FIG. 4, and FIG. 5B particularly depicting the average geometric position(s) 310 of each of the twelve sets of 5 numbers for the New Balanced Super Roulette arrangement of FIG. 3A.

Since there are no Standard Super Roulette wheels, for purposes of comparison, another arrangement, that is, one arrangement of a "Comparative" Super Roulette wheel layout 200 was prepared. This wheel layout was for purposes of determining an effect of the balanced arrangement of indicia in the Balanced Super Roulette wheel (with omission of one or two house numbers)) layout shown in FIG. 3A and is shown in FIG. 4. Although the present application identifies this as comparative, it is to be understood that this roulette wheel arrangement is not "old" as this specific roulette wheel 200 with the specific number arrangements depicted in FIG. 4 has not been publicly disclosed heretofore and has not been used publicly. There is no admission that the "Comparative" Super Roulette wheel layout 200 is "old" in the prior art sense. It is also understood that it is being used for purposes of comparison.

Thus, as shown in FIG. 4, in one embodiment, an arrangement of indicia for a "Comparative" Super Roulette wheel 200 show the compartments numbered and colored clockwise from an optional house number (e.g., 0) as follows: an optional house number (e.g., 0), 10, 27, 48, 9, 26, 55, 12, 33, 54, 11, 30, 47, 8, 29, 46, 20, 37, 58, 19, 36, an optional house number (e.g., 00), 45, 2, 23, 44, 1, 40, 57, 18, 39, 56, 5, 22, 43, 4, 21, 60, 17, 38, 59, 16, an optional house number (e.g., 000), 25, 42, 3, 24, 41, 15, 32, 53, 14, 31, 50, 7, 28, 49, 6, 35, 52, 13, 34, 51. Of this sequence, half of the numbers 27, 9, 55, 33, 11, 47, 29, 20, 58, 36, 2, 44, 40, 18, 56, 22, 4, 60, 38, 16, 42, 24, 15, 53, 31, 7, 49, 35 and 51 are of a first color, e.g., black, and the other half of numbers 10, 48, 26, 12, 54, 30, 8, 46, 37, 19, 45, 23, 1, 57, 39, 5, 43, 21, 17, 59, 25, 3, 41, 32, 14, 50, 28, 6, 52 and 34 are of a second color, e.g., red. This Comparative Super Roulette wheel 200 arrangement of indicia shown in FIG. 4 corresponds and relates to the Super Roulette game surface 100 shown in FIG. 3.

To model this, it is assumed that a Super Roulette wheel is biased in a way that makes one half of the wheel more likely and the other half less likely. It is further assumed that within each half the probabilities of all numbers are equal. Since the Super roulette wheel has an odd number of compartments, the boundary between the more likely and less likely halves passes through the middle of one of the compartments, which is assumed to be unbiased. For each multi-number bet, there is calculated the distribution of the numbers between the "heavy half" and the "light half" of the wheel, averaging over all bets and all ways of splitting the Super roulette wheel into two halves, for the "Comparative" Super and "New" Balanced Super layouts. As mentioned above, there are six even-money (30-number) bets, three 2:1 (20-number) bets, five 4:1 (12-number) bets, eleven 5:1 (10-number) bets, twelve 11:1 (5-number) bets, and forty-four 14:1 (4-number) bets on the Super Roulette game surface 100 layout.

The following percentages refer to the probability that, when the wheel is biased, the numbers involved in the bet will be split between the "heavy" and "light" halves of the wheel as indicated. For even money bets (30 numbers), a 15:15 split means that the wheel's bias does not affect the return of the bet. For 2:1 bets (20 numbers), a 10:10 split means that the wheel's bias does not affect the return of the bet. For 4:1 bets (12 numbers), a 6:6 split means that the wheel's bias does not affect the return of the bet. For 5:1 bets (10 numbers), a 5:5 split means that the wheel's bias does not affect the return of the bet. For 11:1 bets (5 numbers), the best achievable split is 3:2, which minimizes the effect of the wheel's bias. For 14:1 bets (4 numbers), a 2:2 split means that the wheel's bias does not affect the return of the bet.

| | |
|---|---|
| Even money bets | |
| 15:15 split | Comparative Super Roulette arrangement of FIG. 4: 90.48%<br>New Balanced Super Roulette arrangement of FIG. 3A: 90.48% |
| 16:14 split | Comparative Super Roulette arrangement of FIG. 4: 9.52%<br>New Balanced Super Roulette arrangement of FIG. 3A: 9.52% |
| 2:1 bets | |
| 10:10 split | Comparative Super Roulette arrangement of FIG. 4: 100%<br>New Balanced Super Roulette arrangement of FIG. 3A: 100% |
| 4:1 bets | |
| 6:6 split | Comparative Super Roulette arrangement of FIG. 4: 100%<br>New Balanced Super Roulette arrangement of FIG. 3A: 100% |
| 5:1 bets | |
| 5:5 split | Comparative Super Roulette arrangement of FIG. 4: 60.46%<br>New Balanced Super Roulette arrangement of FIG. 3A: 83.26% |
| 6:4 split | Comparative Super Roulette arrangement of FIG. 4: 8.66%<br>New Balanced Super Roulette arrangement of FIG. 3A: 15.58% |
| 7:3 split | Comparative Super Roulette arrangement of FIG. 4: 9.81%<br>New Balanced Super Roulette arrangement of FIG. 3A: 1.15% |
| 8:2 split | Comparative Super Roulette arrangement of FIG. 4: 9.24%<br>New Balanced Super Roulette arrangement of FIG. 3A: 0.00% |
| 9:1 split | Comparative Super Roulette arrangement of FIG. 4: 8.66%<br>New Balanced Super Roulette arrangement of FIG. 3A: 0.00% |
| 10:0 split | Comparative Super Roulette arrangement of FIG. 4: 3.17%<br>New Balanced Super Roulette arrangement of FIG. 3A: 0.00% |
| 11:1 bets | |
| 3:2 split | Comparative Super Roulette arrangement of FIG. 4: 41.80%<br>New Balanced Super Roulette arrangement of FIG. 3A: 80.89% |
| 4:1 split | Comparative Super Roulette arrangement of FIG. 4: 32.80%<br>New Balanced Super Roulette arrangement of FIG. 3A: 19.05% |
| 5:0 split | Comparative Super Roulette arrangement of FIG. 4: 25.40%<br>New Balanced Super Roulette arrangement of FIG. 3A: 0.00% |

-continued

| 14:1 bets | |
|---|---|
| 2:2 split | Comparative Super Roulette arrangement of FIG. 4: 69.84%<br>New Balanced Super Roulette arrangement of FIG. 3A: 85.86% |
| 3:1 split | Comparative Super Roulette arrangement of FIG. 4: 15.01%<br>New Balanced Super Roulette arrangement of FIG. 3A: 13.56% |
| 4:0 split | Comparative Super Roulette arrangement of FIG. 4: 15.15%<br>New Balanced Super Roulette arrangement of FIG. 3A: 0.58% |

Figure 5A:
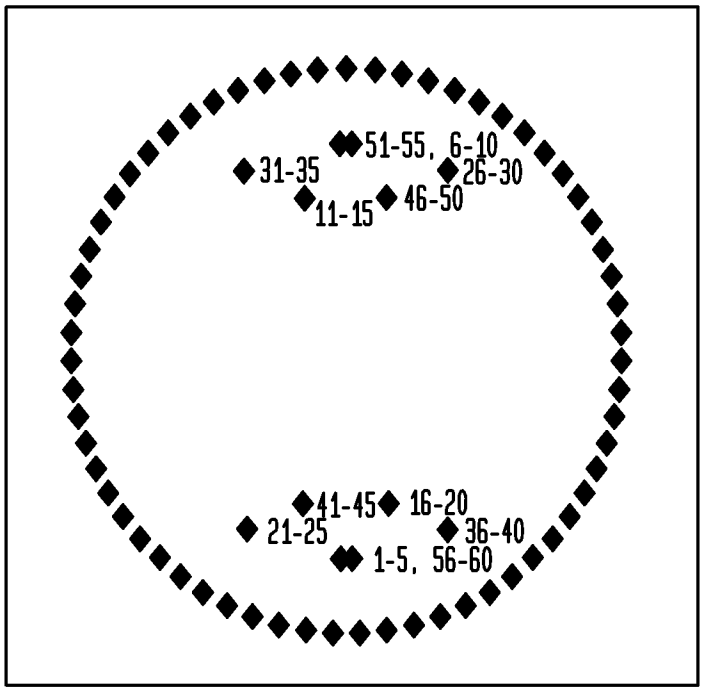
Figure 5B:
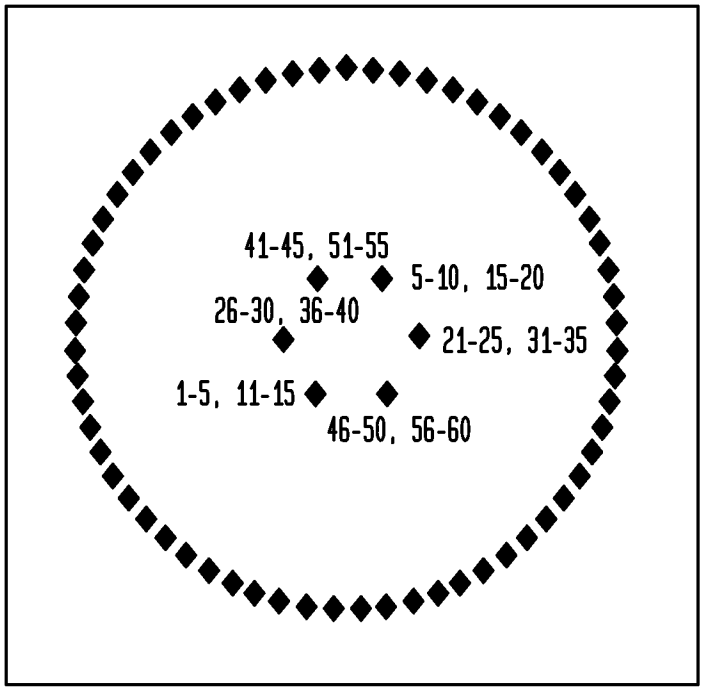

FIGS. 5A, 5B shows a charts that depicts the average geometric position of each of the twelve sets of 5 numbers (i.e., 11:1 bets) that can be bet together (1-5, 6-10, . . . , 56-60,), where the Roulette wheel is place with a house number (e.g., 0) slot at the top with FIG. 5A particularly depicting the average geometric position(s) 300 of each of the twelve sets of 5 numbers for the "Comparative" Super Roulette arrangement of FIG. 4, and FIG. 5B particularly depicting the average geometric position(s) 310 of each of the twelve sets of 5 numbers for the New Balanced Super Roulette arrangement of FIG. 3A.

Balanced Roulette Wheel:

The odds for Balanced Roulette are the same as the odds for Standard Roulette (a House Edge of 1/37, or 2.70%, for European wheels, and a House Edge of 2/38, or 5.26%, of American wheels). Balanced American and European Roulette and Super Roulette wheels also reduce the impact of a bias in the physical wheel on the return of multi-number bets that pay even money (18-number bets) 2:1 (12-number bets), 5:1 (6-number bets), and 8:1 (4-number bets) compared with Standard Roulette wheels. The table below shows, for each configuration, based on mathematical simulations applied, the probability of a bet having the indicated deviation from perfect balance (so that 0 means exactly half the number in the bet are in the "heavy" half of the wheel, +1 means that there is 1 additional number in that half of the wheel, etc.)

| | Average over 4 bet types | | | | |
|---|---|---|---|---|---|
| | <=−2 | −1 | 0 | +1 | >=+2 |
| Standard | | | | | |
| American | 3.070% | 11.802% | 70.375% | 11.683% | 3.070% |
| European | 2.027% | 25.491% | 56.030% | 15.479% | 0.973% |
| Balanced | | | | | |
| American | 0.000% | 5.542% | 89.095% | 5.363% | 0.000% |
| European | 0.00% | 15.407% | 81.398% | 3.194% | 0.000% |

Moreover, a further advantage is provided in the balanced roulette wheel apparatus designed according to the methodology described herein, in that the impact of biased wheel on combinations of multi-numbers bets is minimized.

The Balanced Roulette arrangements described herein minimizes this imbalance for multi-number bets relative to the American and European roulette wheels. For example, the American and European arrangements have additional patterns related to combinations of multi-number bets, as follows: In the European arrangement, each of the following four combinations has all 9 numbers in the same half of the wheel, on one or the other side of a house number, e.g., on the right side of 0, the black #'s (1-18) are 2, 4, 6, 8, 10, 11, 13, 15, 17, and the Red #'s (19-36) are 19, 21, 23, 25, 27, 30, 32, 34 and 36. On the left side of the 0, the Red #'s of (1-18) are 1, 3, 5, 7, 9, 12, 14, 16, 18 and the Black #'s of (19-36) are 20, 22, 24, 26, 28, 29, 31, 33 and 36. 0: Black 1-18, Red 1-18, Black 19-36, and Red 19-36. In the American arrangement, each of the four combinations has all 9 numbers in the same half of the wheel, on one or the other side of a house number, e.g., on the right side of 0, the odd #'s of 1-18 are 1, 3, 5, 7, 9 in Red, and 11, 13, 15, 17 in Black and the even numbers of 19-36 are 20, 22, 24, 26, 28 in Black and 30, 32, 34 and 36 in Red, while on the left side of the 0, the even numbers (1-18) are 2, 4, 6, 8, 10 in Black, 12, 14, 16, 18 in Red and the odd #'s of 19-36 are 19, 21, 23, 25, 27 in Red and 29, 31, 33 and 35 in Black. Bets on these combinations would be strongly affected by either a bias favoring one side of the wheel over the other, or the ability of a croupier to exercise some control over the region of the wheel selected by adjusting the speed of the ball release. The balanced arrangement does not have this pattern. For each combination of two independent 18-number bets, the 9 numbers in both bets are distributed around the wheel rather than concentrated in one half of the wheel.

The only 18 number bet, which are perfectly evenly distributed are the Red and Black bets. Although it is impossible to make all multi-number bets perfectly evenly distributed around the wheel, the Balanced Roulette arrangements minimize this imbalance for multi-number bets.

Besides the reduction in bias on the wheel, the present invention provides a more balanced layout on the game surface relative to the standard layout for the 36 number non-house roulette game. For example, in the game surface, a balanced bet has the lowest correlation with the Red and Black even money bet outcome, and the largest degree of independence from color value. There are 45 multi-number bets of 4 or more numbers on the roulette game. They are depicted below

| Standard Layout | | | Balanced Layout | | |
|---|---|---|---|---|---|
| | Red | Black | | Red | Black |
| Odd | 10 | 8 | Odd | 9 | 9 |
| Even | 8 | 10 | Even | 9 | 9 |
| Low | 9 | 9 | Low | 10 | 8 |
| High | 9 | 9 | High | 8 | 10 |
| $1^{st}$ 12 | 6 | 6 | $1^{st}$ 12 | 6 | 6 |
| $2^{nd}$ 12 | 6 | 6 | $2^{nd}$ 12 | 6 | 6 |
| 3rd 12 | 6 | 6 | 3rd 12 | 6 | 6 |
| $1^{st}$ column | 6 | 6 | $1^{st}$ column | 6 | 6 |
| $2^{nd}$ column | 4 | 8 | $2^{nd}$ column | 6 | 6 |
| $3^{rd}$ column | 8 | 4 | $3^{rd}$ column | 6 | 6 |
| 6-number bets | | | | | |
| 1 bet | 4 | 2 | 3 bets | 4 | 2 |
| 8 bets | 3 | 3 | 5 bets | 3 | 3 |
| 2 bets | 2 | 4 | 3 bets | 2 | 4 |
| 4-number bets | | | | | |
| 18 bets | 2 | 2 | 22 bets | 2 | 2 |
| 4 bets | 1 | 3 | | | |
| Unbalanced bets | | 11 | | | 8 |
| Balanced bets | | 34 | | | 37 |

As seen, there is approximately a 7% advantage on the balanced bets in the Balanced Layout relative to the standard layout while with respect to the unbalanced bets, the standard layout has about a 7% disadvantage relative to the balanced layout.

Thus, the present arrangement minimizes the bias on the roulette wheel and provides for a more balanced betting arrangement on the game surface.

Balanced Super Roulette Wheel:

For the 30-number even money bets, 20-number 2:1 bets, and 12-number 4:1 bets, the "Comparative" Super Roulette and New Balanced Super Roulette wheel of the embodiment of the invention described herein arrangement of numbers around the wheel are equally well-balanced. Assuming one half of the wheel is favored over the other half, the 12-number and 20-number bets are perfectly balanced, and the 30-number bets are perfectly balanced 90.5% of the time and minimally unbalanced (16:14) 9/5% of the time.

For 10-number 5:1 bets, 5-number 11:1 bets, and 4-number 14:1 bets, the New Balanced Super Roulette wheel of the embodiment described herein distributes the numbers around the wheel in a much more balanced way than the "Comparative" Super Roulette arrangement. That is, 10-number bets are split evenly 5:5 83.3% of the time in the New Balanced Super Roulette arrangement, compared with 60.5% of the time in the "Comparative" Super Roulette arrangement. In the New Balanced Super Roulette arrangement, the worst balance for any bet is a 7:3 split, while in the "Comparative" Super Roulette arrangement 21.1% of the time there is a split of 8:2, 9:1, or 10:0 between opposite halves of the wheel.

Further, it is seen that 5-number bets have the best possible 3:2 split 80.9% of the time in the New Balanced Super Roulette arrangement, compared with 41.8% of the time in the "Comparative" Super Roulette arrangement. In the New Balanced Super Roulette arrangement, 5-number bets never have a 5:0 split, while this occurs 25.4% of the time in the "Comparative" Super Roulette arrangement.

With respect to 4-number bets, these are split evenly 2:2 85.9% of the time in the New Balanced Super Roulette arrangement, compared with 69.8% of the time in the "Comparative" Super Roulette arrangement. In the New Balanced Super Roulette arrangement, 4:0 splits occur 0.6% of the time, while this occurs 15.2% of the time in the "Comparative" Super Roulette arrangement.

Accordingly, while several embodiments of the present invention have been shown and described, it is obvious that many changes and modifications may be made thereunto without departing from the spirit and scope of the invention.

What is claimed is:

1. A method for arranging indicia on a game surface and on an associated roulette wheel for a roulette game, the method comprising the steps of:

a) arranging indicia indicating one or more house numbers on the game surface;

b) arranging indicia indicating thirty six whole numbers comprising the numbers 1 through 36, wherein one half of the whole numbers are associated with a first color and a remaining half of the whole numbers are associated with a second color, on the game surface in a matrix of three columns and twelve rows, the whole numbers being arranged in ascending order beginning from a top left corner and proceeding from left to right across the rows;

wherein the whole numbers are arranged in three groups of twelve numbers each, a first group comprising the numbers 1 through 12, a second group comprising the numbers 13 through 24 and a third group comprising the numbers 25 through 36; and wherein each of said first, second and third group comprise three even numbers associated with the first color, three odd numbers associated with first color, three even numbers associated with the second color and three odd numbers associated with the second color;

c) arranging indicia indicating the one or more house numbers on the roulette wheel; and d) arranging indicia indicating each of the thirty six whole numbers on the roulette wheel in a circumferential manner by:

selecting a first whole number associated with the first color and selecting a second whole number associated with the second color, said first and second whole numbers disposed in a single column of said three columns and disposed in a first group of the three groups, and indicating the first whole number and second whole number on the roulette wheel;

selecting a first further whole number associated with the first color and selecting a first further whole number associated with the second color, said first further whole number of said first color and first further whole number of said second color disposed in a single column of said three columns and disposed in a second group of said three groups, and indicating the first further whole number of said first color and first further whole number of said second color on the roulette wheel adjacent to one of: said first whole number or second whole number; and, selecting a second further whole number associated with the first color and selecting a second further whole number associated with the second color, said second further first and second whole numbers disposed in a single column of said three columns and disposed in a third group of said three groups, and indicating the second further whole number of said first color and second further whole number of said second color on the roulette wheel adjacent to one of said first further whole number of said first or second color;

and repeating a first pattern on the roulette wheel such that one pair of adjacent non-house numbers on the roulette wheel are in a same group and same column on said game surface, and each successive pair of adjacent non-house numbers proceeding in a first direction on the roulette wheel from said one pair are in a same group and same column on said game surface;

repeating a second pattern on the roulette wheel such that no two adjacent non-house numbers on the roulette wheel are associated with a same color, are disposed in a same row on the game surface, and are disposed adjacent one another on the game surface; and, repeating a third pattern on the roulette wheel such that a first pair of adjacent non-house numbers on the wheel are both odd numbers and a second pair of non-house numbers adjacent said first pair are both even numbers, and successive alternating first pairs of two adjacent non-house numbers on said wheel proceeding in a first direction are odd; and successive alternating second pairs of two adjacent non-house numbers on said wheel proceeding in said first direction between each said successive alternating first pairs proceeding in said first direction are even.

2. The method according to claim 1, further arranging said whole numbers on the roulette wheel such that:

a third pair of adjacent numbers on the wheel sum to 37, and, a fourth pair of adjacent numbers on the wheel located substantially diametrically opposite said third pair of adjacent numbers on said wheel sum to 37, and such that a first non-house number immediately adjacent one number of said third pair indicated on the wheel in a first direction, and, a corresponding second non-house number immediately adjacent the other number of said third pair indicated on the wheel in a second direction sum to 37; and, repeating a fourth-pattern on the wheel such that, each successive non-house whole number on said wheel proceeding in said first direction between said first non-house number and said fourth pair of adjacent numbers and a corresponding successive non-house whole number on said wheel proceeding in said second direction between said second non-house number and said fourth pair of adjacent numbers sum to 37.

3. The method according to claim 1, wherein a non-house whole number on said wheel and a corresponding non-house whole disposed substantially diametrically opposite said non-house whole number on said wheel are adjacent each other in a single column disposed in one of said first, second, or third groups.

4. The method according to claim 1, wherein a non-house whole number and a corresponding non-house whole disposed substantially diametrically opposite said non-house whole number are the same color.

5. The method according to claim 1, wherein said roulette wheel numbers are arranged in the following clockwise sequence: house number, 18, 24, 11, 5, 30, 36, 23, 17, 4, 10, 35, 29, 16, 22, 3, 9, 28, 34, house number, 15, 21, 8, 2, 27, 33, 20, 14, 1, 7, 32, 26, 13, 19, 6, 12, 25 and 31.

6. The method according to claim 1, wherein each said selected first whole number associated with the first color and selected second whole number associated with the second color are disposed 6 numbers apart on said game surface; each said selected first further whole number associated with the first color and selected first further whole number associated with the second color are disposed 6 numbers apart on said game surface; and, each said selected second further whole number associated with the first color and selected second further whole number associated with the second color are disposed 6 numbers apart on said game surface.

7. The method according to claim 1 wherein the house number are located so as to not break up a pair of adjacent non-house numbers on the roulette wheel which are in the same group and same column on the game surface.

8. A roulette game apparatus comprising:

a) a game surface comprising:

(i) one or more house number wagering areas;

(ii) an even number wagering area;

(iii) an odd number wagering area;

(iv) a first color wagering area;

(v) a second color wagering area;

(vi) a low number wagering area corresponding to a whole number from 1 to 18;

(vii) a high number wagering area corresponding to a whole number from 19 to 36;

(viii) a first dozen wagering area corresponding to a whole number from 1 to 12;

(ix) a second dozen wagering area corresponding to a whole number from 13 to 24;

(x) a third dozen wagering area corresponding to a whole number from 25 to 36; and (xi) thirty six individual number wagering areas, each corresponding to a whole number from 1 to 36, said thirty six individual number wagering areas arranged in ascending order in a matrix of three columns and twelve rows, wherein individual number wagering areas corresponding to numbers 1, 3, 4, 6, 8, 11, 13, 15, 16, 18, 20, 23, 25, 27, 28, 30, 32 and 35 are associated with said first color, and individual number wagering areas corresponding to numbers 2, 5, 7, 9, 10, 12, 14, 17, 19, 21, 22, 24, 26, 29, 31, 33, 34 and 36 are associated with said second color; and b) a roulette wheel comprising a plurality of pockets disposed in a circumferential manner, each of said pockets corresponding to a house number or to a whole number from 1 to 36, wherein each of the whole numbers is associated with said first color or said second color as on said game surface, and wherein said pockets are arranged on said roulette wheel such that one pair of adjacent non-house numbers on the roulette wheel are in a same group and same column on said game surface, and each successive pair of adjacent non-house numbers proceeding in a first direction on the roulette wheel from said one pair are in a same group and same column on said game surface, and, no two adjacent numbers on the roulette wheel are associated with a same color, are disposed in a same row on the game surface, or are disposed adjacent one another on the game surface; and, a first pair of adjacent non-house numbers on the wheel are both odd numbers and a second pair of non-house numbers adjacent said first pair are both even numbers, and successive alternating first pairs of two adjacent non-house numbers on said wheel proceeding in a first direction are odd; and successive alternating second pairs of two adjacent non-house numbers on said wheel proceeding in said first direction between each said successive alternating first pairs proceeding in said first direction are even.

9. The roulette game apparatus according to claim 8, wherein said pockets are arranged such that:

a third pair of adjacent non-house numbers on the wheel sum to 37, and, a fourth pair of adjacent non-house numbers on the wheel located substantially diametrically opposite said third pair of adjacent numbers on said wheel sum to 37, and:

a first non-house number immediately adjacent one number of said third pair indicated on the wheel in a first direction, and, a corresponding second non-house number immediately adjacent the other number of said third pair indicated on the wheel in a second direction sum to 37; and, each successive non-house whole number on said wheel proceeding in said first direction between said first non-house number and said fourth pair of adjacent numbers and a corresponding successive non-house whole number on said wheel proceeding in said second direction from said second non-house number and said fourth pair of adjacent numbers sum to 37.

10. The roulette game apparatus according to claim 8, wherein said pockets are arranged in the following clockwise sequence with respect to a corresponding number: house number, 18, 24, 11, 5, 30, 36, 23, 17, 4, 10, 35, 29, 16, 22, 3, 9, 28, 34, house number, 15, 21, 8, 2, 27, 33, 20, 14, 1, 7, 32, 26, 13, 19, 6, 12, 25 and 31.

11. The roulette game apparatus, according to claim 8, wherein a house number is placed so that it does not break up a pair of adjacent non house numbers on the roulette wheel which are in the same group and the same column on the game surface.

12. A method for arranging indicia on a game surface and on an associated roulette wheel for a roulette game, the method comprising the steps of:

a) arranging indicia indicating one or more house numbers on the game surface;

b) arranging indicia indicating sixty whole numbers comprising the numbers 1 through 60, wherein one half of the whole numbers are associated with a first color and a remaining half of the whole numbers are associated with a second color, on the game surface in a matrix of five columns and twelve rows, the whole numbers being arranged in ascending order beginning from a top left corner and proceeding from left to right across the rows;

wherein the whole numbers are arranged in three groups of twenty numbers each, a first group comprising the numbers 1 through 20, a second group comprising the numbers 21 through 40 and a third group comprising the numbers 41 through 60; and wherein each of said first, second and third group comprise five even numbers associated with the first color, five odd numbers associated with the first color, five even numbers associated with the second color and five odd numbers associated with the second color;

c) arranging indicia indicating the one or more house numbers on the roulette wheel; and d) arranging indicia indicating each of the sixty whole numbers on the roulette wheel in a circumferential manner by:

selecting a first whole number associated with the first color and selecting a second whole number associated with the second color, said first and second whole numbers disposed in a first column of said five columns and disposed in a first group of the three groups, and indicating the first whole number and second whole number as adjacent numbers on the roulette wheel;

selecting a first further whole number associated with the first color and selecting a first further whole number associated with the second color, said first further whole number of said first color and first further whole number of said second color disposed in a second column of said five columns and disposed in a second group of said three groups, and indicating the first further whole number of said first color and first further whole number of said second color as adjacent numbers on the roulette wheel adjacent to one of: said first whole number or second whole number; and, selecting a second further whole number associated with the first color and selecting a second further whole number associated with the second color, said second further whole numbers of first and second colors disposed in a third column of said five columns and disposed in a third group of said three groups, and indicating the second further whole number of said first color and second further whole number of said second color as adjacent numbers on the roulette wheel adjacent to one of said first further whole number of said first or second color;

selecting a third further whole number associated with the first color and selecting a third further whole number associated with the second color, said third further whole numbers of first and second colors disposed in a fourth column of said five columns and disposed in said first group of said three groups, and indicating the third further whole number of said first color and third further whole number of said second color on as adjacent numbers the roulette wheel adjacent to one of said second further whole number of said first or second color;

selecting a fourth further whole number associated with the first color and selecting a fourth further whole number associated with the second color, said fourth further whole numbers of first and second colors disposed in a fifth column of said five columns and disposed in said second group of said three groups, and indicating the fourth further whole number of said first color and fourth further whole number of said second color as adjacent numbers on the roulette wheel adjacent to one of said third further whole number of said first or second color; and repeating a first pattern on the roulette wheel such that one pair of adjacent non-house numbers on the roulette wheel are in a same group and same column on said game surface, and each successive pair of adjacent non-house numbers proceeding in a first direction on the roulette wheel from said one pair are in a same group and same column on said game surface;

repeating a second pattern on the roulette wheel such that no two adjacent non-house numbers on the roulette wheel are associated with a same color, are disposed in a same row on the game surface, and are disposed adjacent one another on the game surface; and, repeating a third pattern on the roulette wheel such that a first pair of adjacent non-house numbers on the wheel are both odd numbers and a second pair of non-house numbers adjacent said first pair are both even numbers, and successive alternating first pairs of two adjacent non-house numbers on said wheel proceeding in a first direction are odd; and successive alternating second pairs of two adjacent non-house numbers on said wheel proceeding in said first direction between each said successive alternating first pairs proceeding in said first direction are even.

13. The method according to claim 12, further arranging said whole numbers on the roulette wheel such that:

a third pair of adjacent non-house numbers on the wheel sum to 61, and, a fourth pair of non-house numbers on the wheel located substantially diametrically opposite said third pair of adjacent numbers on said wheel sum to 61, and such that:

a first non-house number immediately adjacent one number of said third pair indicated on the wheel in a first direction, and, a corresponding second non-house number immediately adjacent the other number of said third pair indicated on the wheel in a second direction sum to 61; and, repeating a fourth pattern on the wheel such that, each successive non-house whole number on said wheel proceeding in said first direction between said first non-house number and said fourth pair of non-house numbers and a corresponding successive non-house whole number on said wheel proceeding in said second direction from said second non-house number and said fourth pair of non-house numbers sum to 61.

14. The method according to claim 12, wherein said a first house number is located on said wheel disposed between said fourth pair of non-house numbers.

15. The method according to claim 12, wherein a non-house whole number and a corresponding non-house whole disposed substantially diametrically opposite said non-house whole number are adjacent each other in a single column disposed in one of said first, second, or third groups.

16. The method according to claim 12, wherein a non-house whole number and a corresponding non-house whole number disposed substantially diametrically opposite said non-house whole number are the same color.

17. The method according to claim 12, having two, three or four house numbers.

18. The method according to claim 12, comprising three house numbers evenly distributed about the circumference of said wheel such that 20 non-house numbers are present between any two house numbers.

19. The method according to claim 12, wherein the house numbers are placed so as to not break up a pair of adjacent non-house numbers on the roulette wheel which are in the same group and same column on the game surface.

20. The method according to claim 12, wherein said roulette wheel numbers are arranged in the following clockwise sequence: house number, 55, 45, 24, 34, 13, 3, 42, 52, 31, 21, 20, 10, 49, 59, 38, 28, 7, 17, 56, 46, house number, 35, 25, 4, 14, 53, 43, 22, 32, 11, 1, 60, 50, 29, 39, 18, 8, 47, 57, 36, 26, house number, 15, 5, 44, 54, 33, 23, 2, 12, 51, 41, 40, 30, 9, 19, 58, 48, 27, 37, 16, 6.

21. The method according to claim 12, wherein each said selected first whole number associated with the first color and selected second whole number associated with the second color are disposed 10 numbers apart on said game surface; each said selected first further whole number associated with the first color and selected first further whole number associated with the second color are disposed 10 numbers apart on said game surface; each said selected second further whole number associated with the first color and selected second further whole number associated with the second color are disposed 10 numbers apart on said game surface; each said selected third further whole number associated with the first color and said selected third further whole number associated with the second color are disposed 10 numbers apart on said game surface; and, said selected fourth further whole number associated with the first color and selected fourth further whole number associated with the second color are disposed 10 numbers apart on said game surface.

22. A roulette game apparatus comprising:

a) a game surface comprising:

(i) one or more house number wagering areas;

(ii) an even number wagering area;

(iii) an odd number wagering area;

(iv) a first color wagering area;

(v) a second color wagering area;

(vi) a low number wagering area corresponding to a whole number from 1 to 30;

(vii) a high number wagering area corresponding to a whole number from 31 to 60;

(viii) a first other wagering area corresponding to a whole number from 1 to 20;

(ix) a second other wagering area corresponding to a whole number from 21 to 40;

(x) a third other wagering area corresponding to a whole number from 41 to 60; and (xi) sixty individual number wagering areas, each corresponding to a whole number from 1 to 60, said sixty individual number wagering areas arranged in ascending order in a matrix of five columns and twelve rows and in three groups of twenty numbers each, a first group comprising the numbers 1 through 20, a second group comprising the numbers 21 through 40 and a third group comprising the numbers 41 through 60; wherein individual number wagering areas corresponding to numbers 1, 3, 5, 6, 8, 10, 12, 14, 17, 19, 21, 23, 25, 26, 28, 30, 32, 34, 37, 39, 41, 43, 45, 46, 48, 50, 52, 54, 57 and 59 are associated with said first color, and individual number wagering areas corresponding to numbers 2, 4, 7, 9, 11, 13, 15, 16, 18 20, 22, 24, 27, 29, 31, 33, 35, 36, 38, 40, 42, 44, 47, 49, 51, 53, 55, 56, 58 and 60 are associated with said second color; and b) a roulette wheel comprising a plurality of pockets disposed in a circumferential manner, each of said pockets corresponding to a house number or to a whole number from 1 to 60, wherein each of the whole numbers is associated with said first color or said second color as on said game surface, and wherein said pockets are arranged on said roulette wheel such that:

one pair of adjacent non-house numbers on the roulette wheel are in a same group and same column on said game surface, and each successive pair of adjacent non-house numbers proceeding in a first direction on the roulette wheel from said one pair are in a same group and same column on said game surface, and, no two adjacent numbers on the roulette wheel are associated with a same color, are disposed in a same row on the game surface, or are disposed adjacent one another on the game surface; and, a first pair of adjacent non-house numbers on the wheel are both odd numbers and a second pair of non-house numbers adjacent said first pair are both even numbers, and successive alternating first pairs of two adjacent non-house numbers on said wheel proceeding in a first direction are odd; and successive alternating second pairs of two adjacent non-house numbers on said wheel proceeding in said first direction between each said successive alternating first pairs proceeding in said first direction are even.

23. The roulette game apparatus according to claim 22, wherein a third pair of adjacent non-house numbers on the wheel sum to 61, and, a fourth pair of non-house numbers on the wheel located substantially diametrically opposite said third pair of adjacent numbers on said wheel sum to 61, and:

a first non-house number immediately adjacent one number of said third pair indicated on the wheel in a first direction, and, a corresponding second non-house number immediately adjacent the other number of said third pair indicated on the wheel in a second direction sum to 61; and, each successive non-house whole number on said wheel proceeding in said first direction between said first non-house number and said fourth pair of non-house numbers and a corresponding successive non-house whole number on said wheel proceeding in said second direction from said second non-house number and said fourth pair of non-house numbers sum to 61.

24. The roulette game apparatus according to claim 23, wherein said pockets are arranged in the following clockwise sequence with respect to a corresponding number: house number, 55, 45, 24, 34, 13, 3, 42, 52, 31, 21, 20, 10, 49, 59, 38, 28, 7, 17, 56, 46, house number, 35, 25, 4, 14, 53, 43, 22, 32, 11, 1, 60, 50, 29, 39, 18, 8, 47, 57, 36, 26, house number, 15, 5, 44, 54, 33, 23, 2, 12, 51, 41, 40, 30, 9, 19, 58, 48, 27, 37, 16, 6.

25. The roulette game apparatus according to claim 22, comprising two, three or four house numbers.

26. The roulette game apparatus according to claim 22 wherein a house number is placed so that it does not break up a pair of adjacent non house numbers on the roulette wheel which are in the same group and the same column on the game surface.

27. The roulette game apparatus according to claim 26, comprising three house numbers evenly distributed about the circumference of said wheel such that 20 numbers are present between any two house numbers.

* * * * *